US012416444B2

(12) United States Patent
Lee et al.

(10) Patent No.: US 12,416,444 B2
(45) Date of Patent: Sep. 16, 2025

(54) PORTABLE REFRIGERATOR AND MAIN REFRIGERATOR HAVING THE SAME

(71) Applicant: LG Electronics Inc., Seoul (KR)

(72) Inventors: Jae Duck Lee, Seoul (KR); Hyoung Keun Lim, Seoul (KR); Hyun Woo Park, Seoul (KR)

(73) Assignee: LG Electronics Inc., Seoul (KR)

( * ) Notice: Subject to any disclaimer, the term of this patent is extended or adjusted under 35 U.S.C. 154(b) by 282 days.

(21) Appl. No.: 17/987,291

(22) Filed: Nov. 15, 2022

(65) Prior Publication Data

US 2023/0221063 A1 Jul. 13, 2023

(30) Foreign Application Priority Data

Jan. 11, 2022 (KR) ..... 10-2022-0004094

(51) Int. Cl.

| | |
|---|---|
| ***F25D 25/00*** | (2006.01) |
| ***F25D 11/02*** | (2006.01) |
| ***F25D 25/02*** | (2006.01) |
| ***F25D 29/00*** | (2006.01) |

(52) U.S. Cl.

CPC ..... *F25D 25/005* (2013.01); *F25D 11/025* (2013.01); *F25D 25/025* (2013.01); *F25D 29/003* (2013.01)

(58) Field of Classification Search

None

See application file for complete search history.

(56) References Cited

U.S. PATENT DOCUMENTS

| | | | | |
|---|---|---|---|---|
| 6,038,865 A * | 3/2000 | Watanabe | A23L 3/365 62/3.6 |
| 6,253,568 B1 * | 7/2001 | Peffley | F25D 25/024 312/405.1 |
| 6,412,286 B1 * | 7/2002 | Park | F25D 11/02 62/3.6 |
| 9,074,810 B2 * | 7/2015 | Hwang | F25D 25/025 |
| 10,088,224 B1 * | 10/2018 | Platts | F25D 11/02 |

(Continued)

FOREIGN PATENT DOCUMENTS

| | | | |
|---|---|---|---|
| CN | 103250015 B * | 6/2015 | F25B 21/02 |
| CN | 107062781 A | 8/2017 | |

(Continued)

OTHER PUBLICATIONS

KR 10-0894478 English Machine Translation (Year: 2009).*

(Continued)

*Primary Examiner* — Jenna M Maroney

(74) *Attorney, Agent, or Firm* — Fish & Richardson P.C.

(57) ABSTRACT

A portable refrigerator is configured to be accommodated in a first cooling space of a main refrigerator and defines a second cooling space independent of the first cooling space. The portable refrigerator includes a case that defines an opening, a drawer configured to be inserted into and drawn out from the case through the opening of the case and configured to, based on being inserted into the case, cover the opening and the second cooling space, a temperature control part configured to control a temperature of the second cooling space, a power supply configured to be selectively connected to external power or indirect power, where the indirect power is supplied through the main refrigerator.

20 Claims, 21 Drawing Sheets

(a)

(b)

(56) References Cited

U.S. PATENT DOCUMENTS

| | | | | |
|---|---|---|---|---|
| 11,098,949 | B2 | 8/2021 | Wantland et al. | |
| 11,255,591 | B1 * | 2/2022 | Sanders | F25D 17/06 |
| 2003/0115892 | A1 | 6/2003 | Fu et al. | |
| 2010/0180606 | A1 * | 7/2010 | Gur | F25D 11/00 62/3.61 |
| 2011/0232323 | A1 | 9/2011 | Morris | |
| 2012/0304667 | A1 * | 12/2012 | Shin | F25B 21/02 62/3.6 |
| 2016/0025388 | A1 * | 1/2016 | Wait | F25B 21/04 62/3.3 |
| 2016/0265837 | A1 * | 9/2016 | Bhatt | F25D 25/025 |
| 2017/0160002 | A1 * | 6/2017 | Kang | F25D 25/025 |
| 2017/0370629 | A1 * | 12/2017 | Fire | B67D 1/0418 |
| 2018/0187946 | A1 * | 7/2018 | Park | F25D 25/025 |
| 2020/0025441 | A1 * | 1/2020 | Ji | F25D 29/003 |
| 2021/0247124 | A1 | 8/2021 | Han et al. | |
| 2021/0354510 | A1 * | 11/2021 | Scalf | B60B 33/045 |
| 2022/0018588 | A1 * | 1/2022 | Grasseschi | F25B 41/40 |
| 2022/0325949 | A1 * | 10/2022 | Al-Thani | F25D 11/00 |
| 2023/0221055 | A1 * | 7/2023 | Park | F25D 11/025 312/401 |

FOREIGN PATENT DOCUMENTS

| | | | | |
|---|---|---|---|---|
| DE | 29806936 | U1 | 6/1998 | |
| EP | 1983282 | | 10/2008 | |
| EP | 2530408 | A2 | 12/2012 | |
| EP | 4209731 | A1 * | 7/2023 | F25B 21/02 |
| JP | 2001201234 | | 7/2001 | |
| KR | 19980015249 | | 6/1998 | |
| KR | 1020060036637 | A | 5/2006 | |
| KR | 1020060042632 | A | 5/2006 | |
| KR | 100632014 | | 10/2006 | |
| KR | 1020070102189 | A | 10/2007 | |
| KR | 100894478 | | 4/2009 | |
| KR | 101146216 | | 5/2012 | |
| KR | 20120133287 | A * | 12/2012 | |
| KR | 20130117313 | A * | 10/2013 | |
| KR | 20170123158 | | 11/2017 | |
| KR | 102216619 | | 2/2021 | |
| KR | 20210147244 | A * | 12/2021 | |
| WO | 2020/175822 | A1 | 9/2020 | |
| WO | WO-2021066342 | A1 * | 4/2021 | |
| WO | WO-2023136415 | A1 * | 7/2023 | F25B 21/02 |

OTHER PUBLICATIONS

Extended Search Report in European Appln. No. EP22191166.2, mailed on Jun. 12, 2023, Jun. 12, 2023.

Partial European Search Report in European Appln. No. 22191166.2, mailed on May 11, 2023, 18 pages.

International Search Report in International Appln. No. PCT/KR2022/011877, dated Nov. 4, 2022, 5 pages.

Office Action in European Appln. No. 22191166.2, mailed on Feb. 6, 2025, 7 pages.

* cited by examiner (a)

(b)

(c)

(d)

(e)

(f)

(a)

(b)

(a) (b)

(a)

(b)

(a)

(b)

(a)

(b)

(a)

(b)

(c)

PORTABLE REFRIGERATOR AND MAIN REFRIGERATOR HAVING THE SAME

CROSS-REFERENCE TO RELATED APPLICATION

This application claims the benefit of Korean Patent Application No. 10-2022-0004094, filed on Jan. 11, 2022, in the Korean Intellectual Property Office, the disclosure of which is incorporated herein in its entirety by reference.

TECHNICAL HELD

This disclosure relates to a portable refrigerator and a main refrigerator including the portable refrigerator.

BACKGROUND

A refrigerator defines a cooling space in a refrigerating chamber and can maintain a temperature. In some cases, the cooling space may include a plurality of spaces cooled to different temperatures.

For example, a refrigerator may include a refrigerator compartment and a freezer compartment that are provided in one space and divided by a partition. In some cases, a refrigerator includes a refrigerating compartment and a freezing compartment that are completely separated in that a cooling system for driving the refrigerating compartment and a cooling system for driving the freezing compartment are separately provided.

As another example, a refrigerator may include a separate independent space in a refrigerator compartment, such as a vegetable compartment or a fresh compartment. The separate independent space may maintain a temperature slightly higher than a temperature of the refrigerator compartment, or maintain a temperature that is a little lower than the temperature of the refrigerator compartment to store food in a suitable temperature. This type of refrigerator may use a singly cooling system using a single refrigerant in the refrigerating compartment, but maintain different temperatures in each space by differentiating the amount of cold air supplied or discharged. In some cases, where a separate cooling system is not, a user may not be able to set a desired temperature for the separate space, and the temperature difference of the separate space may not be significantly different from the temperature of the general area of the refrigerator compartment.

In some cases, a method may implement independent cooling by providing only a plurality of evaporators under a single cooling cycle system and providing the plurality of evaporators in a plurality of spaces. In some cases, the cooling cycle may be complicated, which leads to an increase of the cost of the device.

The independent cooling in the refrigerator may be spatially completely separated from a general refrigerator is also increasing. For example, small refrigerators may be easy to move due to their relatively small volume and weight. Such a small refrigerator has a small volume and weight, and thus can be relatively freely arranged in a living room and a master bedroom, unlike a general refrigerator, which is mainly located in a kitchen area, and there is an advantage that the cost of the device is also relatively low.

In some cases, the small refrigerator may be still heavy and bulky to have complete portability. Therefore, like a general refrigerator, when placed in a specific space, the small refrigerator is generally used fixed in a place without being moved.

In addition, the small refrigerator has a fixed storage space, which is often limited depending on the size or shape of the product. For example, in the case of a small refrigerator providing a horizontally long storage space, many items of a short height such as a small can may be accommodated, but long items such as wine are difficult to be stored. As another example, in the case of a small refrigerator that provides a vertically long storage space, it is easy to store items of a long height, but it is difficult to store many items having a short height, That is, the small refrigerator may not selectively provide a space according to the shape of the stored article due to the limitation of the loading space.

In some cases, users may want to move items stored in a general refrigerator to another place. For example, a user may want to take out cosmetics from a general refrigerator and use the cosmetics in his/her bedroom. In some cases, a user may use a portion of food stored in a general refrigerator while keeping it refrigerated and take it to another place.

In some cases, an independent cooling may be implemented in a general refrigerator, where food or articles may be used in various ways.

For example, a portable cooling device of a 2-way type that can be provided in and used in a general refrigerator or used completely separated from the general refrigerator. For example, when provided in a general refrigerator (hereinafter referred to as "main refrigerator" to distinguish it from a portable cooling device), the internal temperature can be controlled independently. The independent driving can effectively provide a sufficient temperature difference to an independent cooling space that efficiently consumes energy.

In some cases, a power supply may be particularly problematic for the portable cooling device. For example, when used outside, the portable cooling device can be used by an electric wire being connected to an external outlet, but when used in a main refrigerator, an interference may occur between the electric wire and the general refrigerator.

SUMMARY

The present disclosure describes a completely independent cooling device.

For example, the present disclosure describes the completely independent cooling device to be used in a main refrigerator and to be used completely separated from the refrigerator.

The present disclosure further describes a power supply that can provide power to the independent cooling device to be used selectively in or outside the main refrigerator.

The present disclosure further describes an independent cooling device that provides a storage space greater than a storage space of a small refrigerator.

According to one aspect of the subject matter described in this application, a portable refrigerator is configured to be accommodated in a first cooling space of a main refrigerator and defines a second cooling space independent of the first cooling space. The portable refrigerator includes a case that defines an opening, a drawer configured to be inserted into and drawn out from the case through the opening of the case and configured to, based on being inserted into the case, cover the opening and the second cooling space, a temperature control part configured to control a temperature of the second cooling space, a power supply configured to be selectively connected to external power or indirect power, where the indirect power is supplied through the main refrigerator.

Implementations according to this aspect can include one or more of the following features. For example, the temperature control part can include a thermo-electric module. In some examples, the temperature control part can have a first side disposed at an outer surface of the case and a second side disposed at an inner surface of the case.

In some implementations, the temperature control part can be configured to control a range of the temperature of the second cooling space based on an outside temperature of the case. In some examples, the temperature control part can be configured to control a range of the temperature of the second cooling space based on whether the power supply is connected to the external power or the indirect power.

In some implementations, the portable refrigerator can include a controller configured to determine whether the portable refrigerator is accommodated in the first cooling space and to control a range of the temperature of the second cooling space based on determining whether the portable refrigerator is accommodated in the first cooling space. In some examples, the case can have a rectangular parallelepiped shape including (i) an opening surface that defines the opening, (ii) a pair of first surfaces that face each other, and (iii) a pair of second surfaces that face each other, where a width of each of the pair of first surfaces is greater than a width of each of the pair of second surfaces.

In some examples, the portable refrigerator can include an outer roller that is disposed at one of the pair of first surfaces. In some examples, the drawer can include a frame that defines two open sides that face the pair of first surfaces of the case, each of the two open sides defining an opening area, and two closed sides that face the pair of second surfaces of the case. In some examples, the drawer can further include a blocking bar that extends through at least a part of the opening area of the drawer. In some examples, the drawer can further include an auxiliary frame that extends parallel to the two closed sides of the frame and is disposed between the two closed sides of the frame, where the auxiliary frame partitions the opening area into a plurality of opening areas.

In some examples, the pair of first surfaces of the case are configured to face a floor, and the portable refrigerator can include a basket that is disposed in the opening area of the frame and defines a recessed storage space. In some examples, the drawer can include an inner roller configured to protrude based on the drawer being drawn out from the case, where the inner roller is configured to face one of the pair of first surfaces of the case or one of the pair of second surfaces of the case.

In some implementations, the case can include a handle disposed at one of the pair of second surfaces of the case, and the handle can include a link that enables the handle to protrude from and insert into the one of the pair of second surfaces of the case. In some examples, the portable refrigerator can be configured to be stacked with a plurality of portable refrigerators that have a structure identical to the portable refrigerator, where the case of each of the plurality of portable refrigerators has one of the pair of first surfaces that is configured to face one of the first pair of surfaces of another of the plurality of portable refrigerators, and the power supplies of the plurality of portable refrigerators are configured to connect to one another and to a single power source.

In some implementations, the power supply can include a power terminal disposed at the case and configured to receive power. In some examples, the drawer can include a display configured to output visual information and a cable that is connected to the display and the power supply, where the cable includes a coil configured to be stretched and contracted. In some examples, the display can be disposed at a front surface of the drawer, and the drawer can include a frame that includes a rear surface that faces the front surface of the drawer, a frame terminal disposed at the rear surface of the frame and connected to the cable of the drawer, and a conductive line that electrically connects the frame terminal to the display.

In some implementations, the display can be disposed at a front surface of the drawer, where the display includes a display panel that is disposed at the front surface of the drawer and configured to rotate in a range of 90 degrees about an axis perpendicular to the front surface of the drawer.

According to another aspect, a refrigerator that defines a first cooling space and includes a portable refrigerator that is configured to be accommodated in the first cooling space and that defines a second cooling space independent of the first cooling space. The portable refrigerator includes a power terminal. The refrigerator further includes a heat pump configured to cool the first cooling space, and a power supply configured to supply power to the portable refrigerator accommodated in the refrigerator. The power supply includes a housing, a cable disposed in the housing and configured to be connected to the power terminal of the portable refrigerator, and an elastic member configured to apply force to the cable based on the cable being drawn out of the housing to be connected to the portable refrigerator. The elastic member is further configured to insert the cable into the housing based on the cable being disconnected from the portable refrigerator.

In some implementations, a plurality of cooling spaces can be provided in a refrigerating compartment, and the plurality of cooling spaces can maintain a temperature in a completely independent state.

In some implementations, the portable refrigerator can be accommodated in the main refrigerator or independently provided outside the main refrigerator.

In some implementations, power can be connected in an appropriate manner depending on the case of the portable refrigerator being accommodated in the main refrigerator and the case of being independently provided outside.

In some implementations, when the portable refrigerator is stored in the main refrigerator and operates, a separate power line may not be provided for driving the portable refrigerator from the outside.

In some implementations, it can be possible to replace a complex system such as a cooling cycle system, thereby contributing to the miniaturization and weight reduction of the portable refrigerator.

In some examples, where the internal temperature range is determined based on the external temperature of the portable refrigerator, efficient energy consumption is possible. In some examples, the portable refrigerator can be used selectively by laying down or standing up. In some examples, the portable refrigerator can be easily accommodated in the main refrigerator through an outer roller provided in the case of the portable refrigerator.

In some examples, drawing out and drawing in of the drawer can be easily implemented through an inner roller provided in the drawer of the portable refrigerator. In some examples, the portable refrigerator can be moved more easily through a handle provided on the portable refrigerator, and when the handle is not in use, the handle may not protrude from the case, so that the portable refrigerator can be conveniently used.

In some implementations, where a plurality of portable refrigerators are stacked, they are structurally stable, and the plurality of portable refrigerators can be driven together with a single power source.

In some examples, a stable electrical connection can be implemented to a display part provided on the drawer. In some examples, vertical and horizontal arrangements of the portable refrigerator can be made through the rotatable display.

Further scope of applicability of the present disclosure can become apparent from the following detailed description. However, it should be understood that specific embodiments such as detailed descriptions and example embodiments are given as mere examples since various changes and modifications within the spirit and scope of the present disclosure can be clearly understood by those skilled in the art.

DETAILED DESCRIPTION

Figure 1:
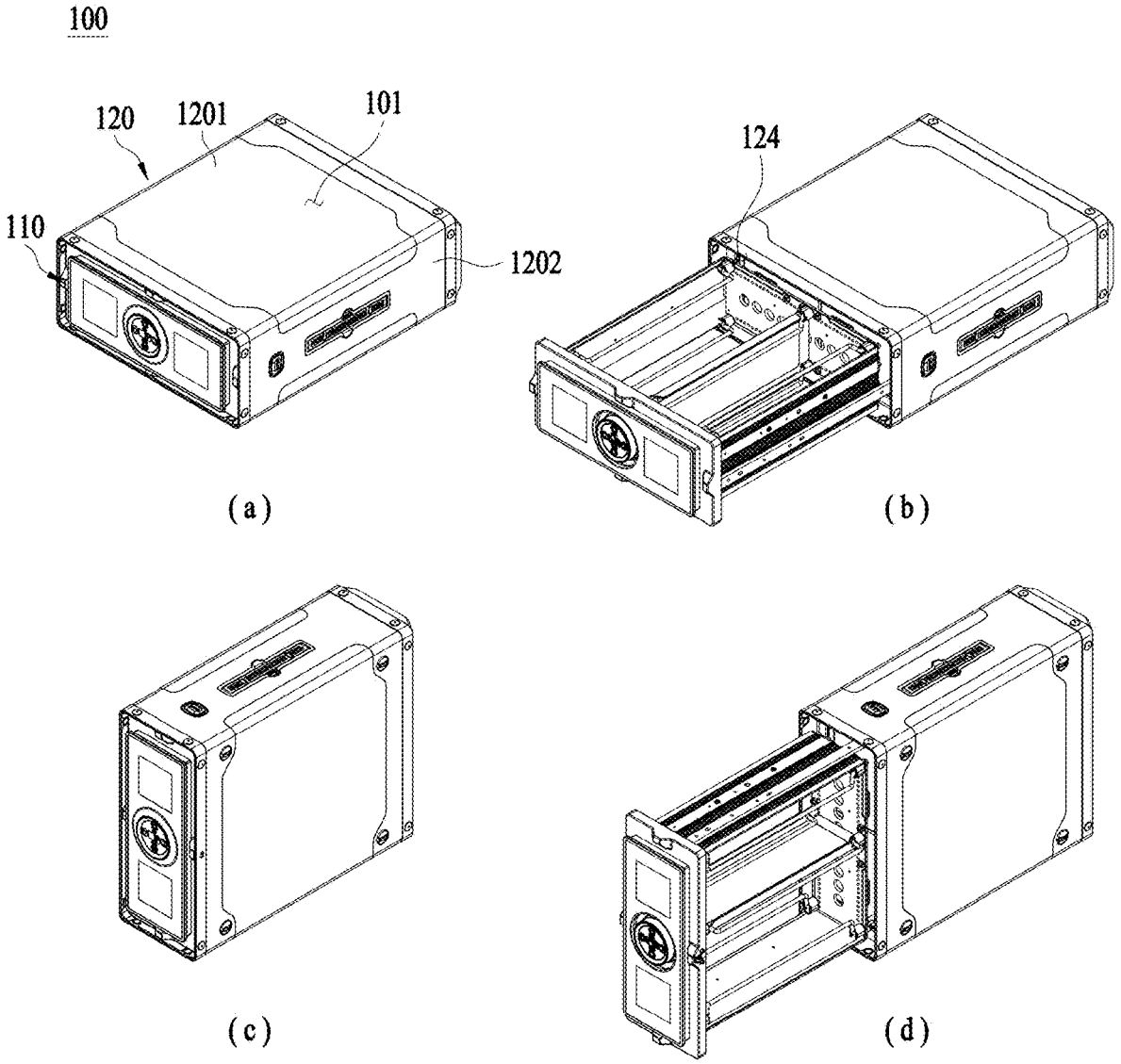
FIG. 1 illustrates an example of a portable refrigerator and example states before and after a drawer is drawn in and out of the portable refrigerator, where the portable refrigerator is horizontally mounted and vertically mounted.

Hereinafter, example implementations will be described in detail with reference to the accompanying drawings, but regardless of a reference numeral in drawing, the same or similar components refer to the same reference numeral, and redundant description thereof will be omitted.

Figure 2:
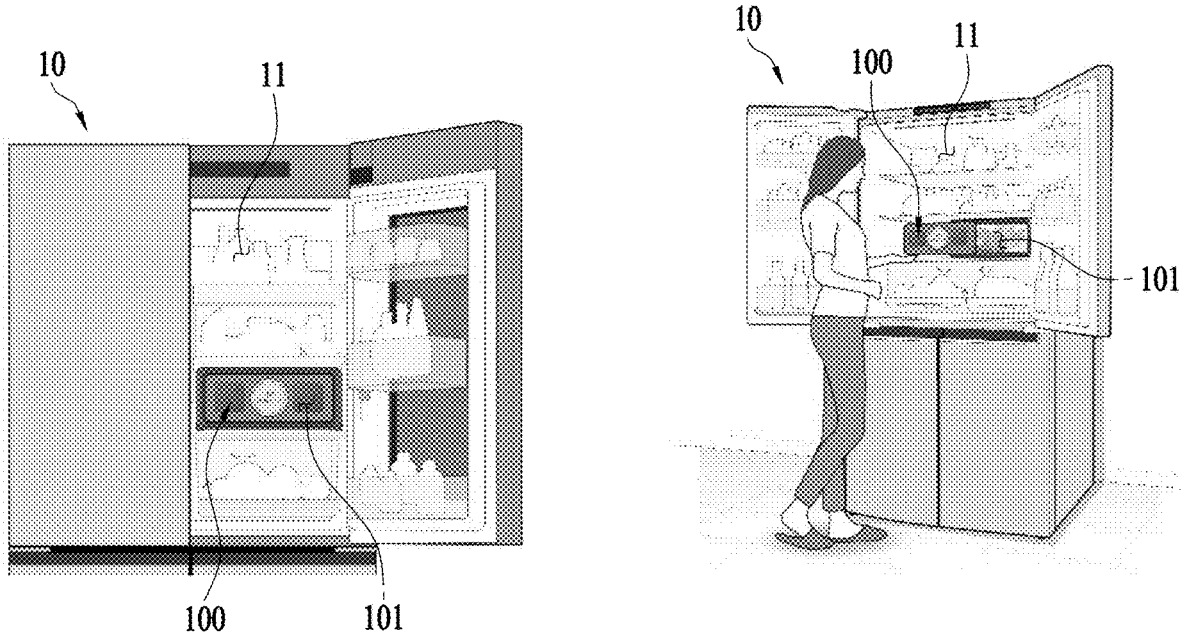
FIG. 2 illustrates an example of the portable refrigerator that is accommodated in a main refrigerator.
Figure 3:
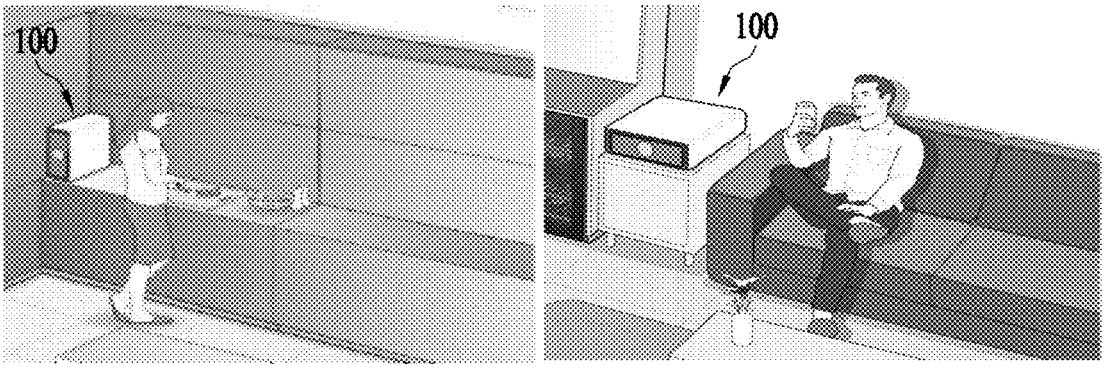
FIG. 3 illustrates examples of the portable refrigerator that is independently driven in different spaces.
Figure 3:
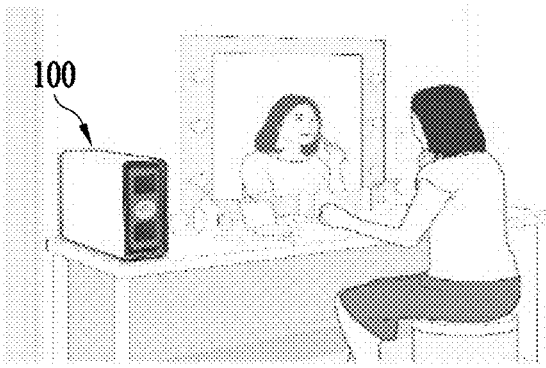
Figure 3:
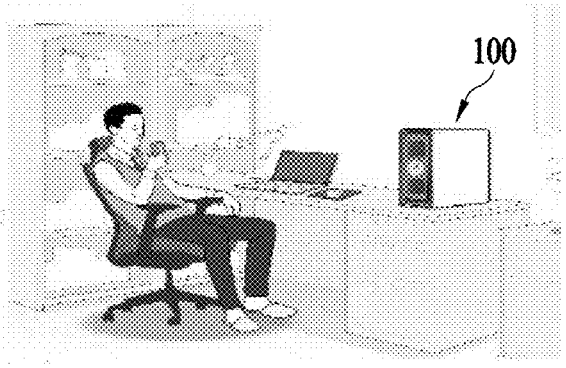
Figure 3:
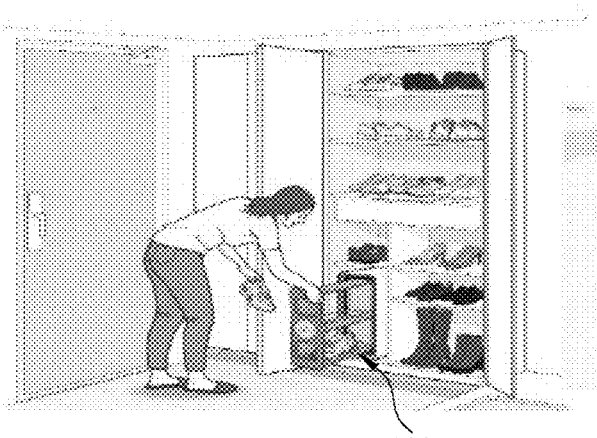
Figure 3:
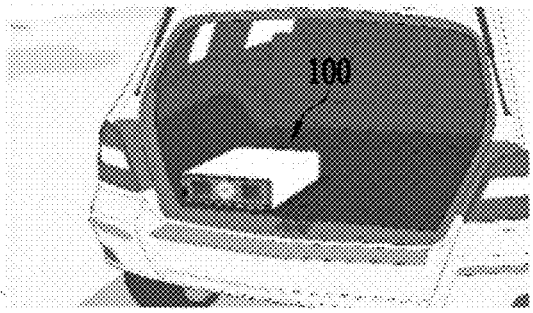
Figure 4:
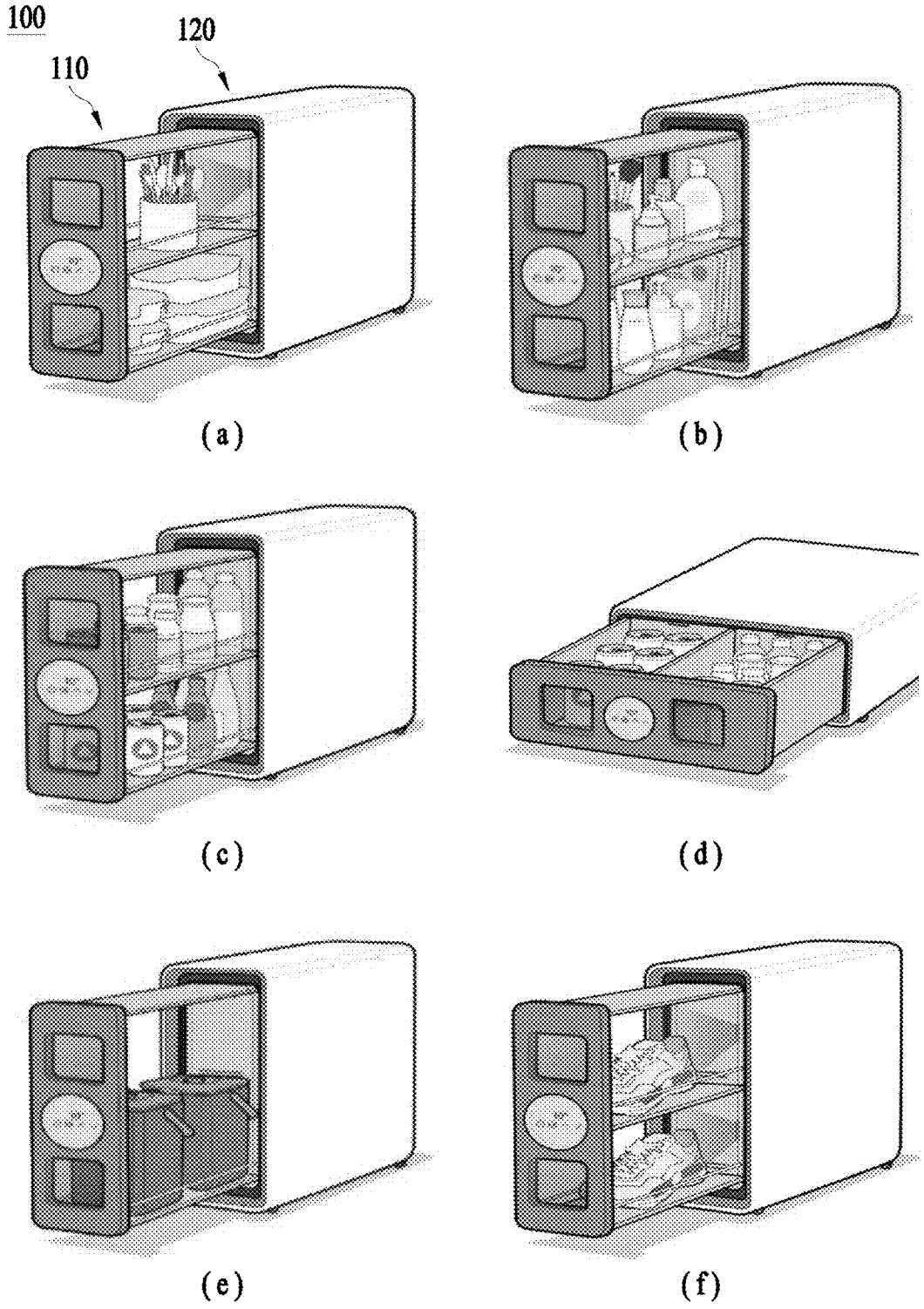
FIG. 4 illustrates examples of the portable refrigerator that is independently driven and stores different types of articles.

FIG. 1 illustrates an example of a portable refrigerator 100 including a drawer 110 that is drawn in and out of the portable refrigerator 100, where the portable refrigerator 100 is in horizontally mounted and vertically mounted states, FIG. 2 illustrates an example of the portable refrigerator 100 that is accommodated in a main refrigerator 10 and driven. FIG. 3 illustrates examples of the portable refrigerator 100 that is independently driven according to arranged spaces of the portable refrigerator 100. FIG. 4 illustrates examples of the portable refrigerator 100 that is independently driven according to types of articles stored in the portable refrigerator 100.

In some implementations, the portable refrigerator 100 can be configured to be accommodated in a first cooling space 11 of the main refrigerator 10 as shown in FIG. 2, and define a second cooling space 101 independent of the first cooling space 11. In some examples, as shown in FIGS. 3 and 4, the portable refrigerator 100 can be fully drawn out from the main refrigerator 10 and disposed at an arbitrary location to function as an independent refrigerator.

For example, as shown in FIG. 2, the main refrigerator 10 functions as a master device, and the portable refrigerator 100 functions as a slave device. Herein, the main refrigerator 10 and the portable refrigerator 100 are only named based on the relative relationship, and their roles are not limited to their names.

The main refrigerator 10 can independently implement a cooling function. There is no limitation on a method for implementing a cooling function, but it would be common to mount a system for implementing a cooling cycle using a refrigerant. The cooling cycle can include an evaporator, a condenser and a compressor, and the refrigerant circulates through these components to absorb external heat or radiate heat to the outside.

In some examples, a space in which the portable refrigerator 100 is accommodated is generally a refrigerating compartment of the main refrigerator 10, but can be provided in a freezer compartment as needed. In some cases, the portable refrigerator 100 can be provided in the both compartments. The present disclosure describes, for example, the portable refrigerator 100 that is stored in the refrigerating compartment of the main refrigerator 10.

The portable refrigerator 100 can include a case 120 and a drawer 110 that can be drawn out from the case 120. An inner space formed by the case 120 and the drawer 110 forms an independent cooling space only for the portable refrigerator 100.

The portable refrigerator 100 can have a substantially rectangular parallelepiped shape. In particular, the rectangular parallelepiped can include a pair of first surfaces (i.e., two wide surfaces) 1201 facing each other among four surfaces adjacent to the drawer 110 and a pair of second surfaces (i.e., two narrow surfaces) 1202 facing each other, to have the overall flat shape.

The portable refrigerator 100 having the flat shape can be used horizontally as shown in (a) and (b) of FIG. 1, or used vertically as shown in (c) and (d) of FIG. 1. Depending on whether the portable refrigerator 100 is independently used, whether the portable refrigerator 100 is horizontally mounted or vertically mounted can vary. Meanwhile, when the portable refrigerator 100 is accommodated in the main refrigerator 10, considering the shelf structure constituting the space mainly in the horizontal direction of the main refrigerator 10, the portable refrigerator 100 can be used horizontally.

When the portable refrigerator 100 is used independently of the main refrigerator 10, the portable refrigerator 100 can be used in various spaces and in various ways.

For example, the portable refrigerator 100 can be used in a sink to conveniently store ingredients used for cooking (see (a) of FIG. 3). As another example, the portable refrigerator 100 can be provided in a rest area such as a living room or a work space and used for the purpose of storing snacks (see (b) and (d) of FIG. 3). In some examples, cosmetics can be stored in the portable refrigerator 100 in a space such as a power room (see (c) of FIG. 3). In some examples, shoes can be stored in the portable refrigerator 100 in a space such as a shoe cabinet (see (e) of FIG. 3). The portable refrigerator 100 can be stored in a vehicle, moved and used for camping (see (f) of FIG. 3). In some examples, the portable refrigerator 100 can store food waste (see (e) of FIG. 3). There can be a case that food waste is stored in the main refrigerator 10 in order for spoilage of the food waste to be temporarily prevented. In this case, there is a problem in that the main refrigerator 10 does not provide a separate sealed space, so the smell leaks out. When food waste is stored in the portable refrigerator 100, the food waste is sealed once more by the portable refrigerator 100 with airtightness, thereby improving convenience.

In order to implement the functions described above, the portable refrigerator 100 can include a component for implementing a sterilization function, for example, a UV sterilization part.

The characteristic that the portable refrigerator 100 can be accommodated in the main refrigerator 10 and can be driven independently brings various advantages. For example, when the portable refrigerator 100 stores food or cosmetics, the portable refrigerator 100 is normally stored in the main refrigerator 10 and used continuously, and the portable refrigerator 100 can be drawn out from the main refrigerator 10 and temporarily used in a necessary space. In this case, there is an advantage in that there is no need to take out and move a stored item separately. Furthermore, when going on a trip such as camping, unlike the conventional case in which the necessary food needs to be transferred to a separate bag or icebox for movement, the portable refrigerator 100 can be drawn out and moved. Thus, it is convenient and it is much more advantageous for maintaining the freshness of food. In particular, if there is an environment in which power is provided in a moving vehicle, or the portable refrigerator 100 is provided with a separate battery for driving a cooling function, a desired temperature can be maintained while moving.

Figure 5:
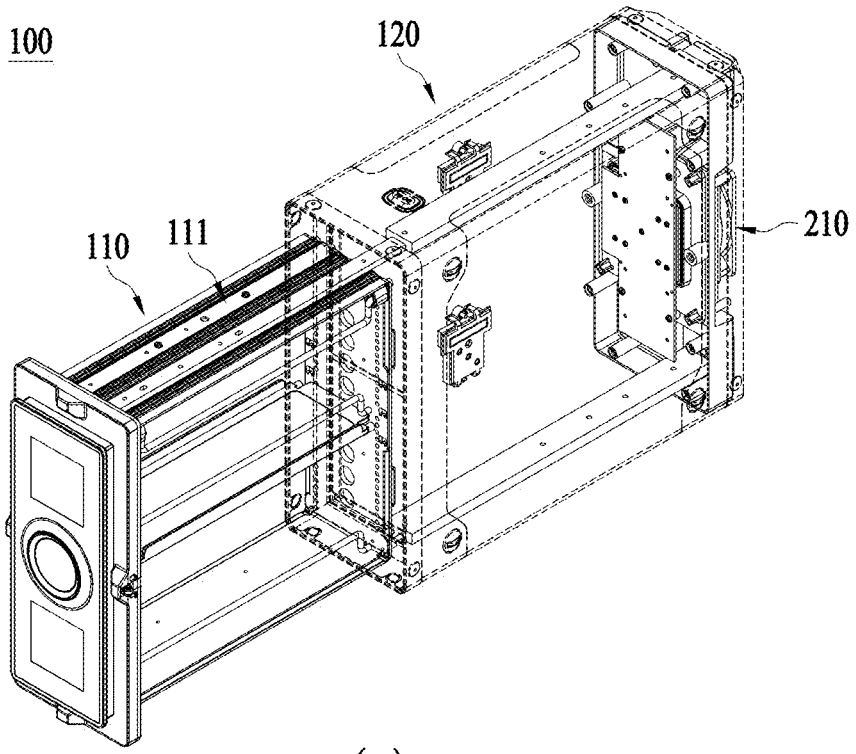
FIG. 5 illustrates a perspective view and a rear view of the portable refrigerator.
Figure 5:
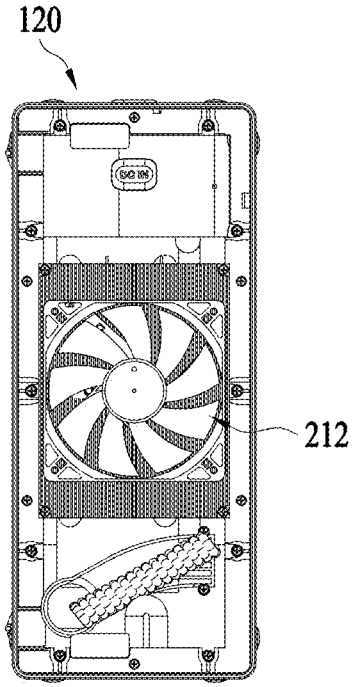

FIG. 5 illustrates a perspective view and a rear view of the portable refrigerator 100.

As described above with FIG. 2, the second cooling space 101 of the portable refrigerator 100 is independent of the first cooling space 11 of the main refrigerator 10. Meanwhile, independent cooling may not mean that factors influencing the temperatures of the two spaces are completely excluded. For example, the temperature of the first cooling space 11 can affect the temperature of the second cooling space 101 due to the characteristics of the cooling system.

In order to implement the independent cooling structure of the portable refrigerator 100, first, the cooling system of the second cooling space 101 has to be provided separately from the cooling system of the first cooling space 11, and second, the first cooling space 11 and the second cooling space 101 have to be physically independent spaces.

The portable refrigerator 100 has a temperature control part 210 for cooling the second cooling space 101. The temperature control part 210 can be implemented in various ways. The temperature control part 210 can be implemented as, for example, a method of a thermo-electric module 211. The thermo-electric module 211 is an electronic cooling/heating device using the Peltier effect, and controls temperature by supplying electricity to a semiconductor device. The thermo-electric module 211 has the advantage of being significantly smaller and lighter than a cooling cycle system using a refrigerant, and thus the thermo-electric module 211 is suitable for application to the portable refrigerator 100. When the thermo-electric module 211 is provided as the temperature control part 210, one side of the thermo-electric module 211 is provided on an outer surface of the case 120 and exposed to the outside, and the other side can be provided on an inner surface of the case 120 to be exposed to the second cooling space 101. In order to improve the heat dissipation performance of the thermo-electric module 211, the temperature control part 210 can further include a fan 212.

The case 120 and the drawer 110 of the portable refrigerator 100 can include a heat insulating member in order to minimize heat loss caused by the outside (an external space independent of the first cooling space 11 or the main refrigerator 10) of the second cooling space 101.

Furthermore, the drawer 110 can fully seal an opening 124 formed by the case 120. That is, a sealing structure for minimizing heat loss can be implemented at the boundary point of the drawer 110 and the case 120. The sealing structure can be implemented with a material such as rubber.

Accordingly, it can be considered that the portable refrigerator 100 is fully covered with a heat insulating member. However, when the temperature control part 210 is exposed to the outside like the thereto-electric module 211, the heat insulating member may not be provided in an area corresponding to the temperature control part 210.

The thermo-electric module 211 can be installed on the rear surface of the case 120, for example.

The temperature control part 210 can control an operating temperature range of the second cooling space 101 in response to the temperature outside the case 120. The operating temperature range can be controlled differently, for example, when the portable refrigerator 100 is provided in the main refrigerator 10 and when separately provided outside the main refrigerator 10, that is, the outside temperature is distinguished different. In general, when the portable refrigerator 100 is provided in the main refrigerator 10, the temperature outside the portable refrigerator 100 is lower than the temperature outside the portable refrigerator 100 when the portable refrigerator 100 is provided separately outside of the main refrigerator 10.

In some examples, where temperature control part 210 includes the thermo-electric module 211, the cooling performance of the thermo-electric module 211 is also affected by the temperature of the external space. When the external temperature is relatively high, even if the same power is used, the temperature of the second cooling space 101 may not be lowered much. Therefore, the operating temperature range can be set in consideration of such circumstances. For example, when the portable refrigerator 100 is accommodated in the main refrigerator 10, the operating temperature range can be set to 5° C. to 18° C., and when the portable refrigerator 100 is disposed outside the room temperature, the operating temperature range can be set to 8° C. to 18° C.

Herein the operating temperature range refers to a range in which a user's set temperature can be specified. For example, when the operating temperature range is −5° C. to 18° C., the user can set 0° C. as the set temperature of the range, and the system can be driven so that the second cooling space 101 can reach the set temperature 0° C.

The specification of the operating temperature range can be performed by the controller. The controller takes on a physical form such as a chipset, and refers to a configuration that performs calculations according to various conditions and data and generates signals for commands to each component. For example, the controller can be a system-on-chip (SOC).

The portable refrigerator 100 of the present disclosure can include a temperature measuring sensor that directly measures the external temperature. In some examples, it can be determined whether the portable refrigerator 100 is in a state stored in the main refrigerator 10 or a state disposed outside, simply based on the power connect form. The controller can determine whether the portable refrigerator 100 is accommodated in the first cooling space 11 based on the above logical structure, and can adjust the operating temperature range of the second cooling space 101 based on a result of the determining.

Figure 6:
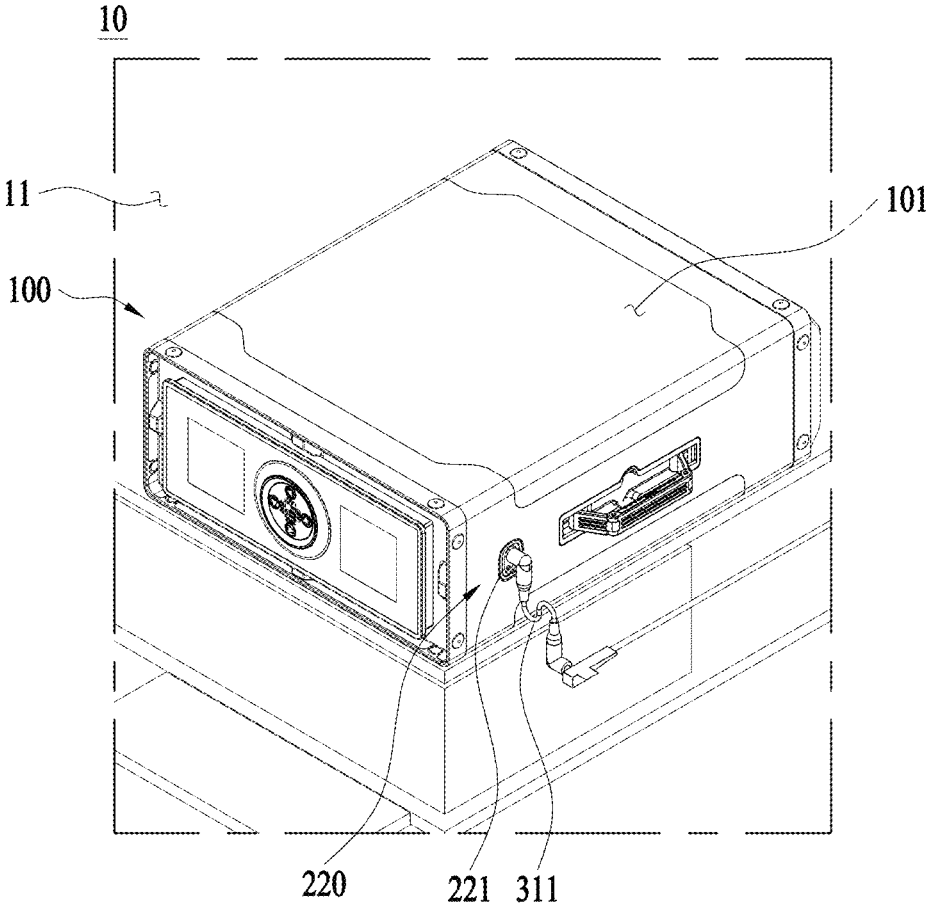
FIG. 6 is a perspective view illustrating an example of the portable refrigerator that is accommodated in the main refrigerator.

FIG. 6 is a perspective view illustrating a state in which the portable refrigerator 100 is accommodated in the main refrigerator 10.

A power supply 220 of the portable refrigerator 100 supplies power for driving to the temperature control part 210 and a display part 151 to be described later. The power supply 220 can receive power from the outside. In some cases, the power supply 220 can store power received from the outside, including a battery.

The power supply 220 can include a power terminal 221 to which an external power line is connected to receive external power. When the portable refrigerator 100 is independently disposed outside the main refrigerator 10, an external power source can be connected, and when the portable refrigerator 100 is accommodated in the main refrigerator 10, indirect power supplied through the main refrigerator 10 can be connected. The indirect power can take the form of a cable 311 drawn out from an electronic part of the main refrigerator 10 to the first cooling space 11. The indirect power can be provided by being branched from electricity received by the main refrigerator 10 from the outside.

A terminal of the cable 311 is connected to the power terminal 221 of the power supply 220 of the portable refrigerator 100. When the cable 311 is excessively long, and when the portable refrigerator 100 is stored in the main refrigerator 10, problems such as tangle and interference of the cable 311 can be caused. In some examples, when the cable 311 is provided with a short length, the cable 311 can be provided with an appropriate length because a user may not easily connect it. The cable can be long enough to allow the terminal of the cable 311 to be connected to the power terminal 221 in a state where the portable refrigerator 100 is inserted into the main refrigerator 10 by ⅔. After connecting the cable 311, the portable refrigerator 100 can be fully drawn into a storage area of the first cooling space 11.

Figure 7:
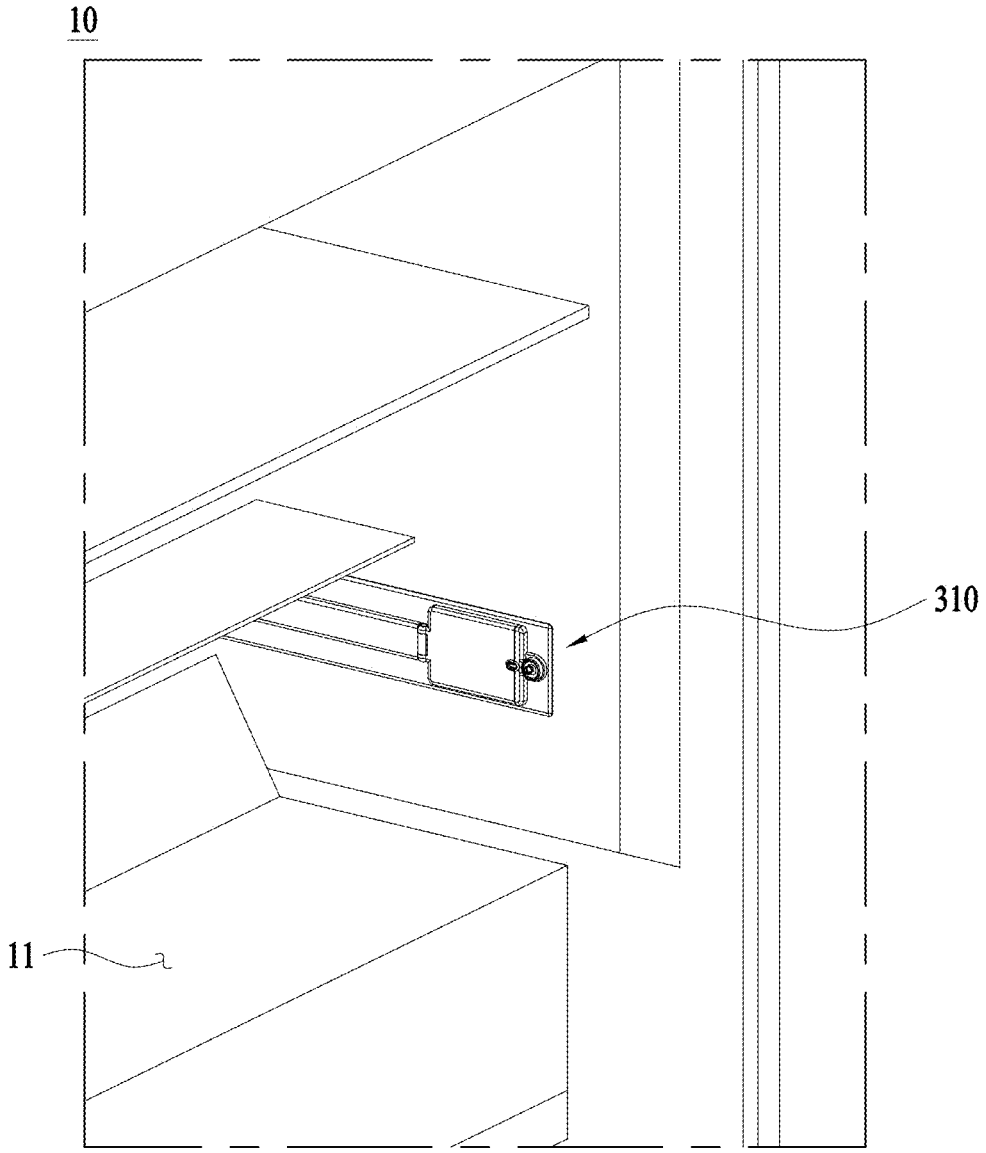
FIG. 7 illustrates an example of a cable holder of the main refrigerator.
Figure 8:
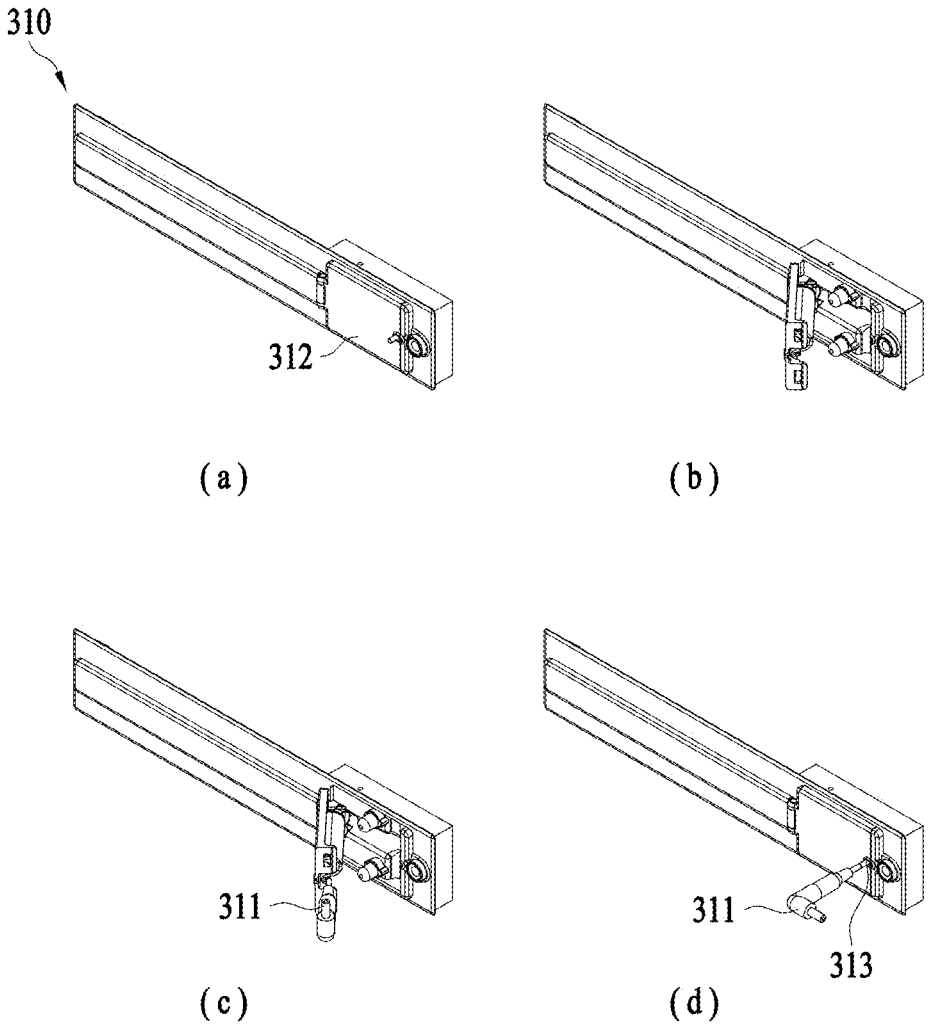
FIG. 8 illustrates an example of a process of drawing out a cable from the cable holder and fixing the cable.
Figure 9:
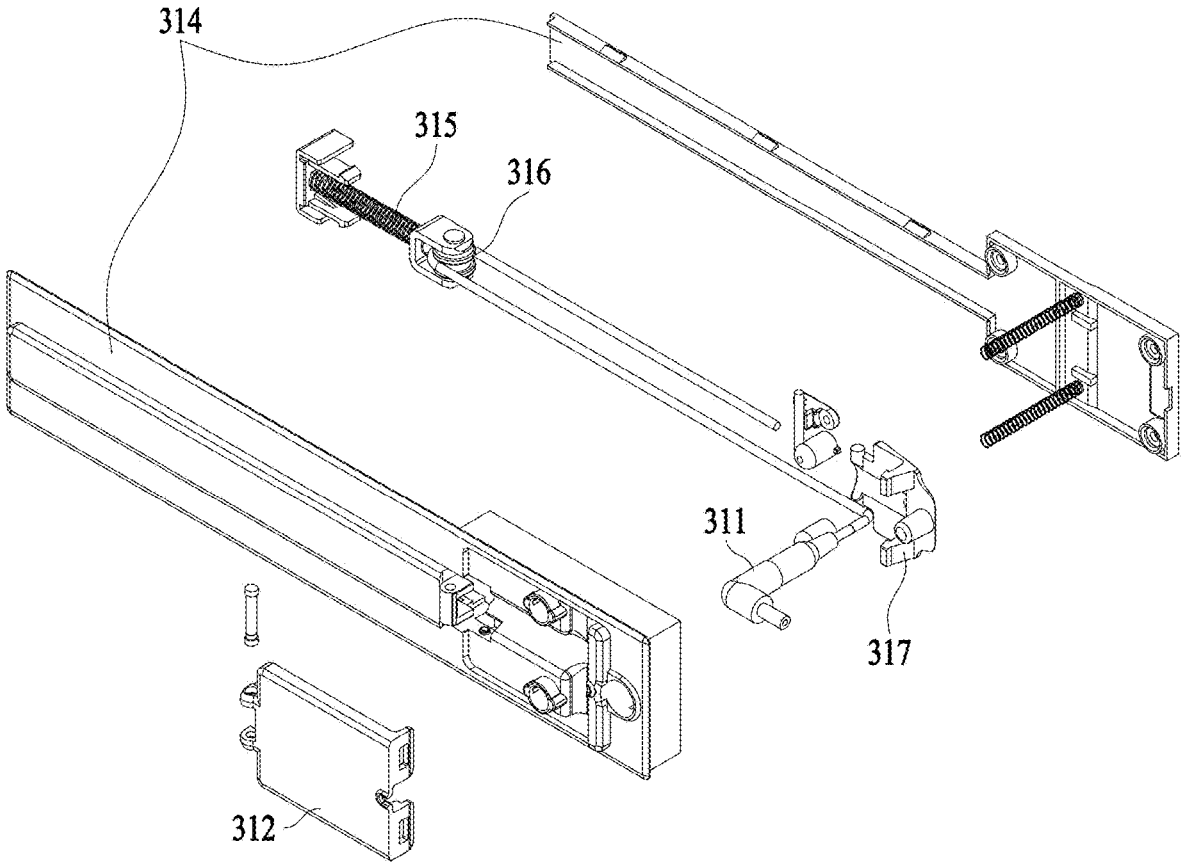
FIG. 9 is an exploded perspective view of the cable holder.
Figure 10:
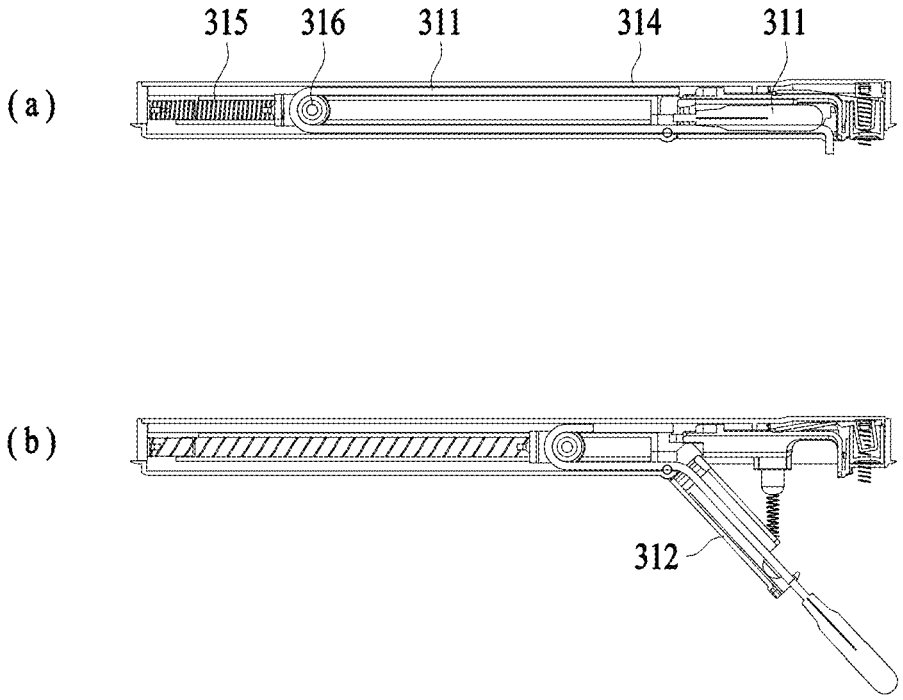
FIG. 10 illustrates longitudinal cross sections of the cable holder.

FIG. 7 illustrates an example of a cable holder 310 of the main refrigerator 10, FIG. 8 illustrates a process of drawing out the cable 311 from the cable holder 310 and fixing the cable 311, FIG. 9 is an exploded perspective view of the cable holder 310, and FIG. 10 illustrates longitudinal cross sections of the cable holder 310.

In some examples, the main refrigerator 10 can include a space that accommodates the cable 311 when not in use. The cable holder 310 can be provided on a side wall of the main refrigerator 10 corresponding to an area in which the portable refrigerator 100 is accommodated.

The cable holder 310 can include a housing 314 and a cover 312. The housing 314 prevents the influence of the first cooling space 11 from being affected by mounting components of the cable holder 310 therein and having the cable 311 provided therein when not in use.

When the cover 312 is opened, the cable 311 can be drawn out from the cable holder 310. The cable holder 310 is provided with an elastic member 315 that provides a restoring force to generate a force to retract the pulled out cabled 311 to the inside. The force drawn inward allows the cable 311 to be easily drawn into the inside of the cable holder 310 when not in use. The cable 311 drawn out to connect the cable 311 to the portable refrigerator 100 can be fixed to a fixing groove 313 of the cover 312. The fixing groove 313 prevents the cable 311 from being drawn into the cable holder 310 despite the restoring force of the elastic member 315.

A roller 316 of the cable holder 310 allows the cable 311 to be wound without being tangled in the cable holder 310.

The cover 312 of the cable holder 310 can be fastened to the cable holder 310 by a method of a hook 317.

Figure 11:
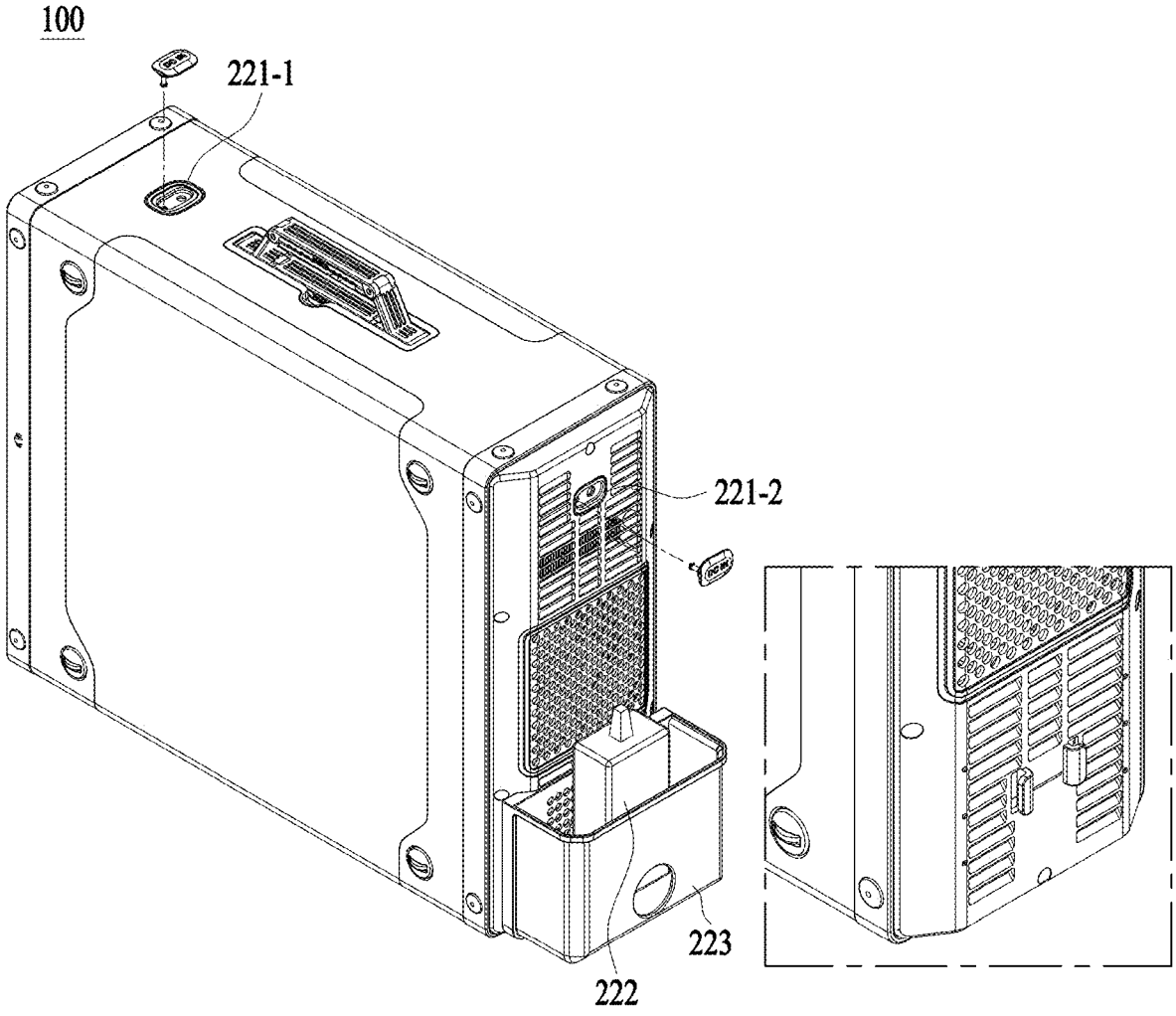
FIG. 11 illustrates an example of a rear of the portable refrigerator.

FIG. 11 illustrates the rear of the portable refrigerator 100. (a) of FIG. 11 illustrates a state in which the adapter holder 223 is coupled to the rear surface of the case 120, and (b) of FIG. 11 illustrates the rear surface of the case 120 in a state in which the adapter holder 223 is separated.

A plurality of power terminals 221-1 and 221-2 of the power supply 220 can be provided so that the cable 311 can be selectively connected. For example, the power terminal 221-2 can be provided on the rear surface of the portable refrigerator 100. The power terminal 221-2 provided on the rear surface can be used when the portable refrigerator 100 is independently provided outside.

When the portable refrigerator 100 is independently provided outside, the portable refrigerator 100 can be connected to an external power source through an adapter 222. An adapter holder 223 can be provided on the rear surface of the case 120 for storage of the adapter 222. The adapter holder 223 can be configured to be detachably attached to the rear surface of the case 120 as necessary. For example, the adapter holder 223 can be coupled to the rear surface of the case 120 by the hook 317.

Figure 12:
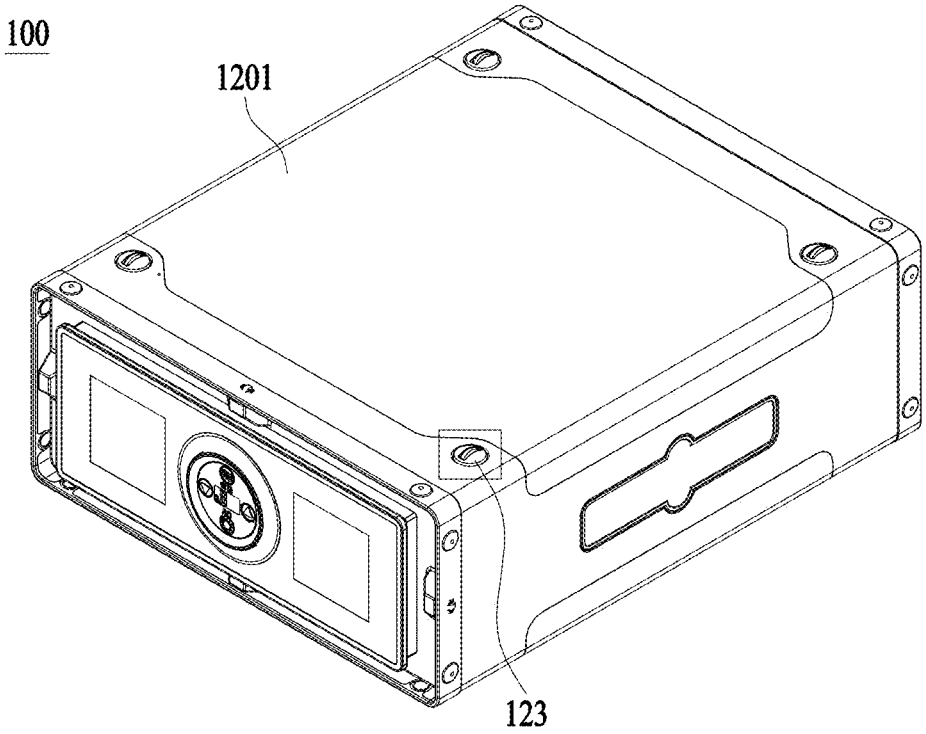
FIG. 12 illustrates an example of a wide surface of the portable refrigerator.
Figure 12:
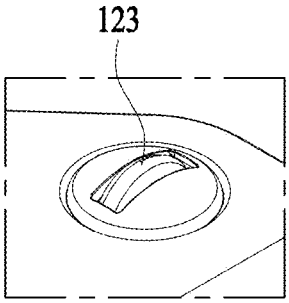

FIG. 12 illustrates an example of a wide surface 1201 of the portable refrigerator 100.

The portable refrigerator 100 can further include an outer roller 123 provided on the wide surface 1201 of the case 120. For instance, the outer roller 123 can be provided at four corners of the wide surface 1201. The outer roller 123 can minimize frictional force generated when the portable refrigerator 100 is accommodated in the main refrigerator 10 or when the accommodated portable refrigerator 100 is taken out of the main refrigerator 10.

Figure 13:
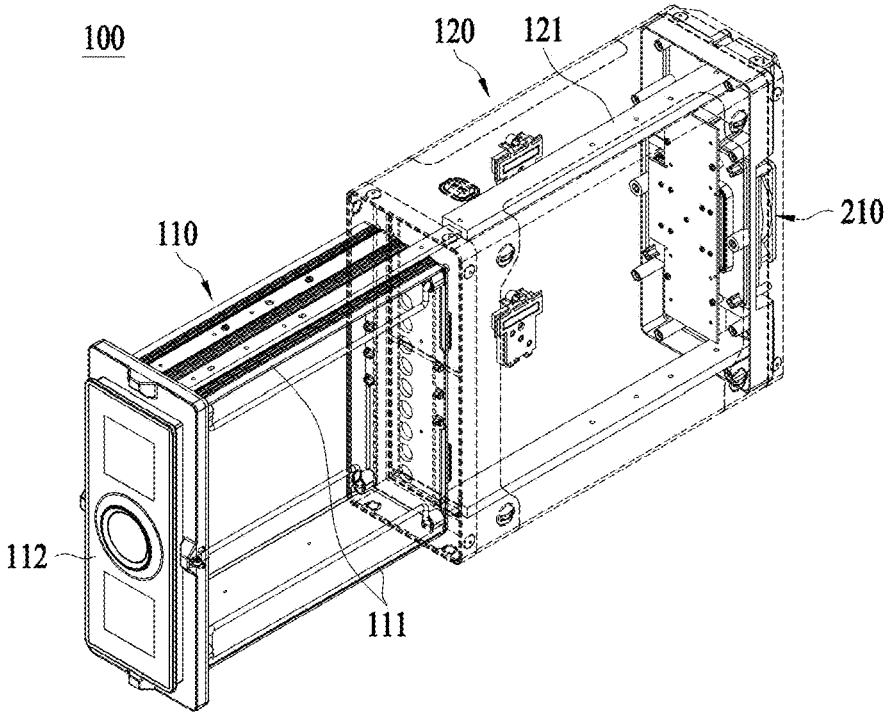
FIGS. 13-17 illustrates examples of the portable refrigerator.
Figure 13:
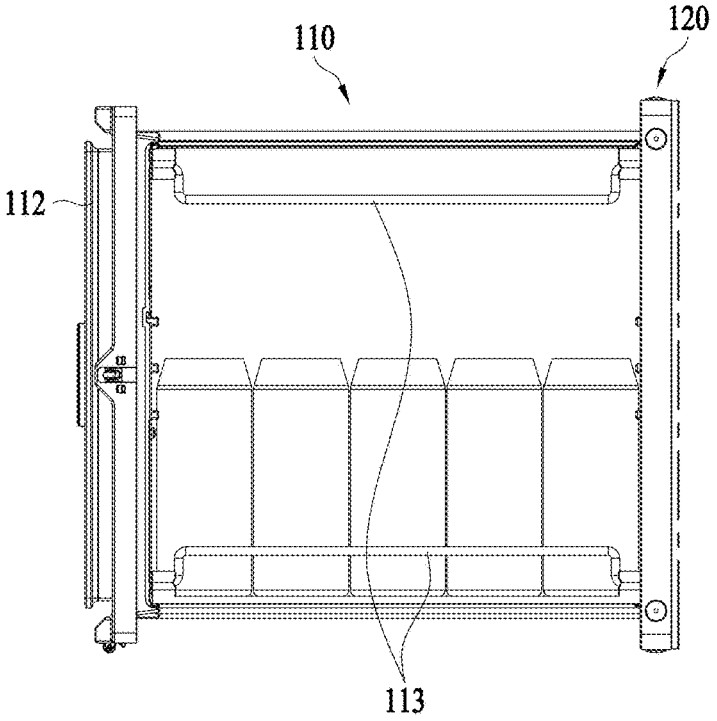

FIG. 13 illustrates the portable refrigerator 100. (a) of FIG. 13 is a perspective view, and (b) of FIG. 13 is a side view.

A drawer 110 seals the opening 124 of the case 120 and provides a space in which items such as food can be accommodated. A frame 111 provides a skeleton through which the drawer 110 can be drawn out and drawn into the case 120.

The frame 111 can include a sliding structure movable on the case 120, and the case 120 can provide a corresponding rail 121. At this time, the rail 121 can be provided in three stages so that the drawer 110 can be drawn out or drawn into by a sufficient distance.

The frame 111 can be at least a part of the circumference of the four surfaces that are consecutively connected to the front panel 112 of the drawer 110. That is, the drawer 110 forms an opening area 115 corresponding to the two wide surfaces 1201 of the case 120, and forms a closed side corresponding to the two narrow surfaces 1202.

When the portable refrigerator 100 is vertically mounted, an item to be stored can be put in through the side and stored on the frame 111. A blocking bar 113 forming a bump can be provided in the side opening area 115 of the drawer 110. The blocking bar 113 can be provided along the draw-in direction of the drawer 110. For example, the blocking bar 113 can be provided I the form of connecting the front panel 112 of the drawer 110 and the rear surface of the frame 111. The blocking bar 113 helps prevent the foods seated on the frame 111 from being separated.

Figure 14:
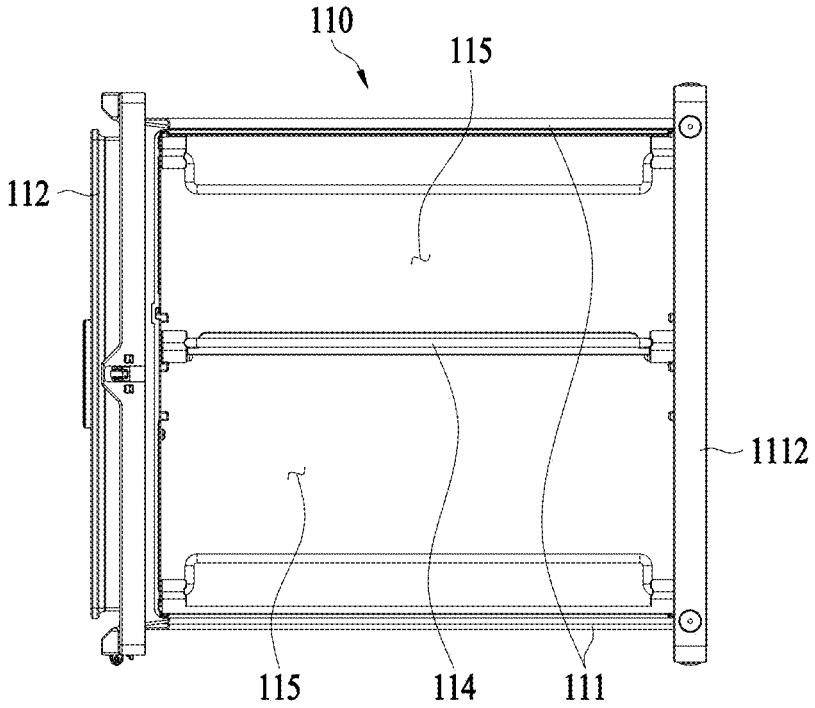
Figure 14:
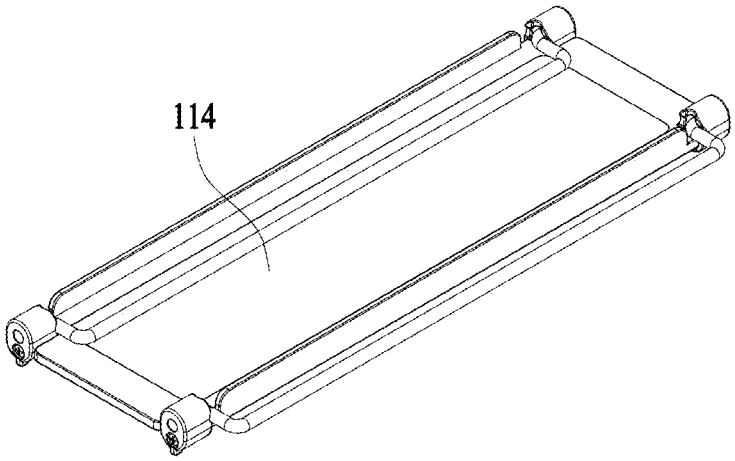

FIG. 14 illustrates an example of the portable refrigerator 100.

An auxiliary frame 114 can be provided between two closing surfaces of the frame 111, and can be provided to be parallel to the two surfaces to partition the opening area 115 formed by the frame 111 into a plurality.

The auxiliary frame 114 can be supported by the front panel 112 and a rear surface of the frame 1112 of the drawer 110, and by varying the height of the auxiliary frame 114, the height of the fixed and partitioned area can be flexibly adjusted.

Figure 15:
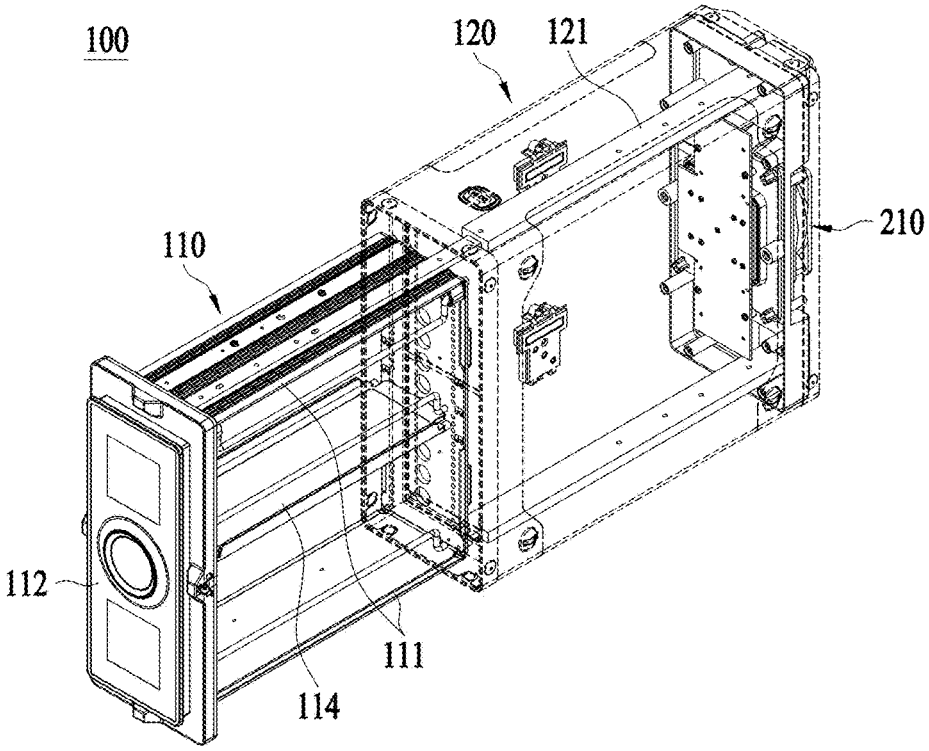
Figure 15:
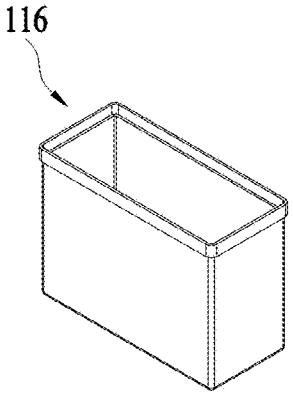
Figure 15:
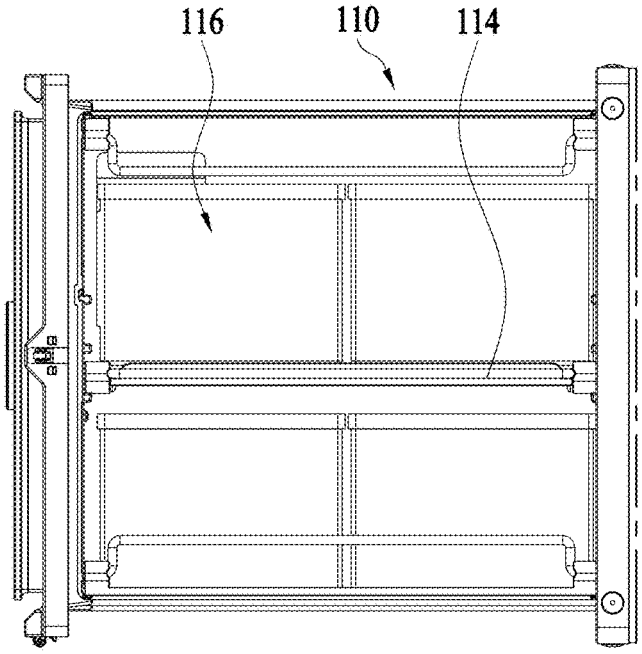
Figure 16:
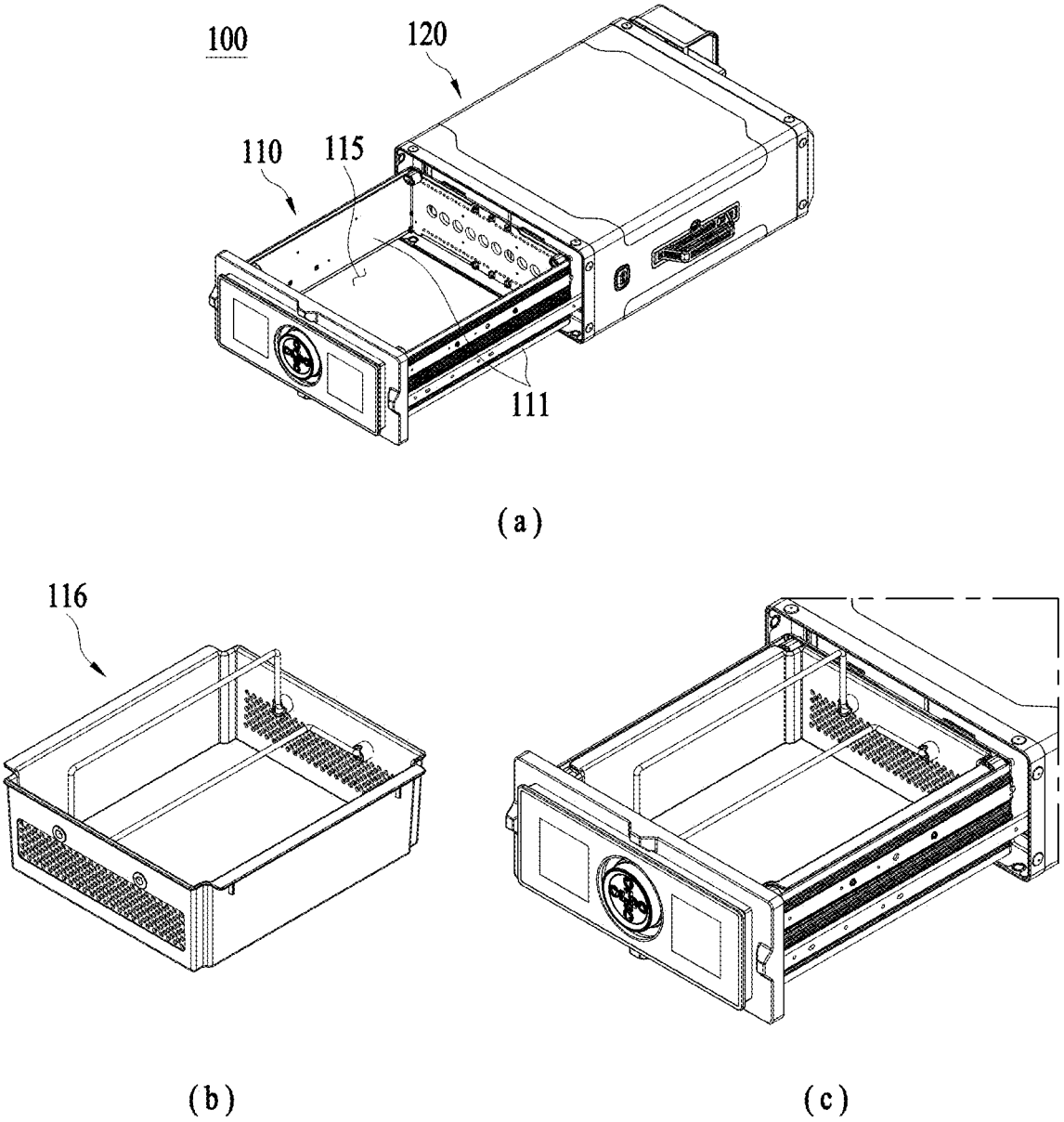

FIGS. 15 and 16 illustrate examples of the portable refrigerator 100.

A basket 116 can be additionally mounted on the frame 111 or the auxiliary frame 114 to provide a recessed storage space.

The basket 116 can be mounted on a surface of the frame 111 or the auxiliary frame 114 (see FIG. 15), or can be provided in a form that spans the edge of the auxiliary frame 114 (see FIG. 16). In particular, in the latter case, the basket 116 is seated in the opening area 115 formed by the frame 111 or the auxiliary frame 114. For example, when the portable refrigerator 100 is mounted horizontally as shown in FIG. 16, the basket 116 can be seated in the opening area 115 of the frame 111 to provide a storage space. The rim boundary of the basket 116 has a size and shape corresponding to the boundary edge of the frame 111 so that the basket 116 can be stably mounted.

Figure 17:
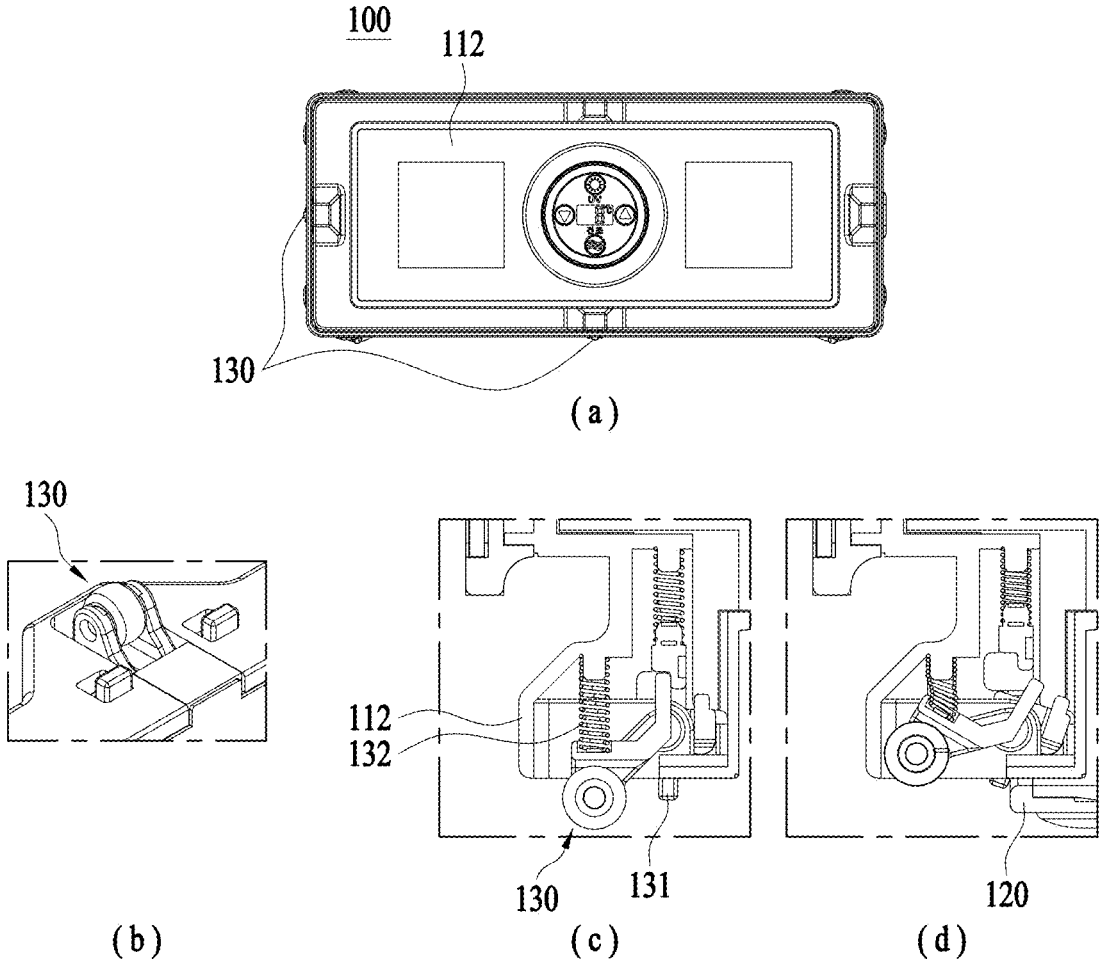

FIG. 17 illustrates an example of the portable refrigerator 100.

The drawer 110 can include an inner roller 130 that protrudes outward as the drawer 110 is drawn out from the case 120. The inner roller 130 can be provided on the front panel 112 of the drawer 110 in a direction that can become a bottom surface. That is, the inner rollers 130 are provided on the short edge sides and the long edge sides with respect to the front surface of the front panel 112, respectively, and thus when the portable refrigerator 100 is mounted vertically or horizontally, the portable refrigerator 100 can be used in the both cases.

Since the inner roller 130 has a latch structure, when the drawer 110 is fully drawn into the case 120 as shown in (d) of FIG. 17, the inner roller 130 is drawn to inside of the front panel 112, and when the drawer 110 is drawn out from the case 120 as shown in (c) of FIG. 17, the restraint is released and the inner roller 130 protrudes to the outside of the front panel 112. In order to implement this structure, the inner roller 130 can include a trigger member 131 that is provided to protrude to the outside and interferes with the case 120. When the interference of the trigger member 131 and the case 120 is released, at least one spring 132 can be provided so that the inner roller 130 can protrude.

Figure 18:
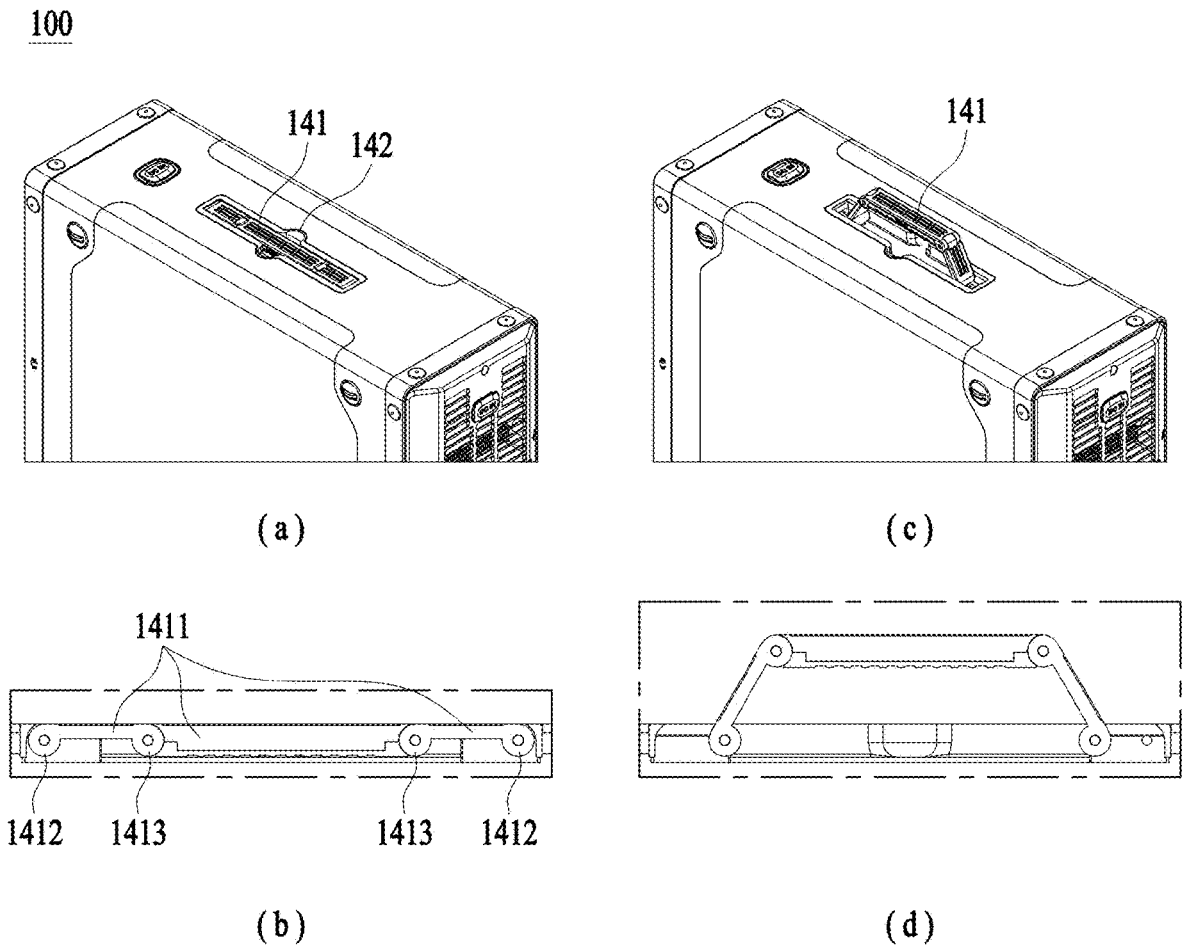
FIG. 18 illustrates an example of a handle of the portable refrigerator.

FIG. 18 illustrates before and after a handle 141 of the portable refrigerator 100 is drawn out.

The portable refrigerator 100 can be provided with the handle 141 so as to be easily moved. The handle 141 can be provided on one surface of the case 120, and the surface can be the narrow surface 1202. When provided on the narrow surface 1202, it is a little easier to carry and move the portable refrigerator 100.

The handle 141 is provided so as not to protrude from one surface of the case 120 when not in use, and the handle 141 can be pulled out when in use and provided to protrude from the one surface of the case 120. For example, the handle 141 and the case 120 can have a slide 4-bar linkage structure having two joints and two sliding joints. Four bars 1411 included in the case 120 are fastened by two joints 1413 and sliding-joints 1412, and when the handle 141 is not in use, the two sliding-joints are spaced apart. When the handle 141 is in use, the two sliding-joints become closer and the center of the handle 141 rises.

The case 120 can include a groove 142 in order to easily grab and take out the handle 141, drawn into the inside when not in use.

Figure 19:
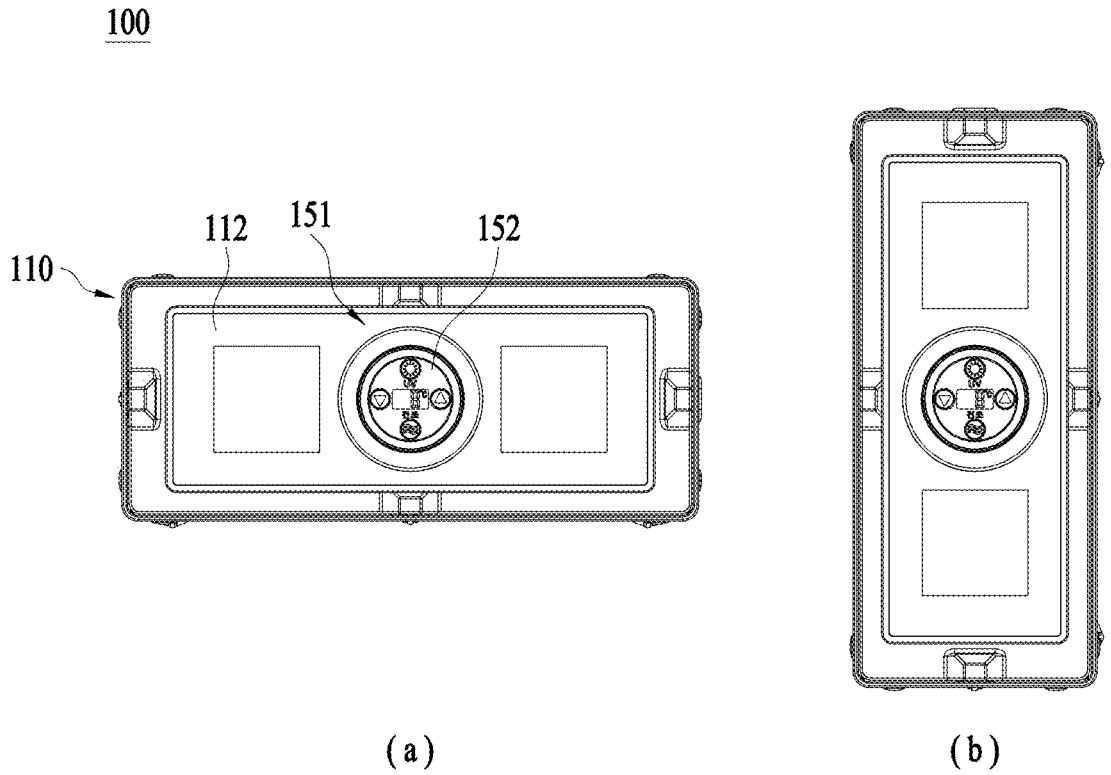
FIG. 19 illustrates example states of the portable refrigerator.

FIG. 19 illustrates two states of the portable refrigerator 100.

The portable refrigerator 100 can include a display part 151 that outputs visual information. The visual information can be information related to the portable refrigerator 100. For example, the visual information can be an actual temperature or a set temperature of the second cooling space 101. In some examples, the visual information can be information about an item stored in the portable refrigerator 100.

The display part 151 can be mounted on the front surface of the drawer 110, that is, the front panel 112. A display panel 152 of the display part 151 is exposed to the front panel 112 of the drawer 110. At least some components of the display part 151 including the display panel 152 can be rotatable by 90 degrees on the front surface of the drawer 110. This is in consideration of two states, which are the vertical mounting (see (b) of FIG. 19) and the horizontal mounting ((a) of FIG. 19) of the portable refrigerator 100. can be included are a sensor that senses the mounding direction so that the display panel 152 automatically rotates according to the mounting direction of the portable refrigerator 100, and a driving part that rotates the display panel 152 according to the sensed mounting direction. In some examples, display panel 152 can be configured to be rotated directly by a user.

The rotation of the display panel 152 can be implemented in a range of 90 degrees. This is because, if there is no restriction on the rotation angle, a problem can occur due to kinking of wiring.

Figure 20:
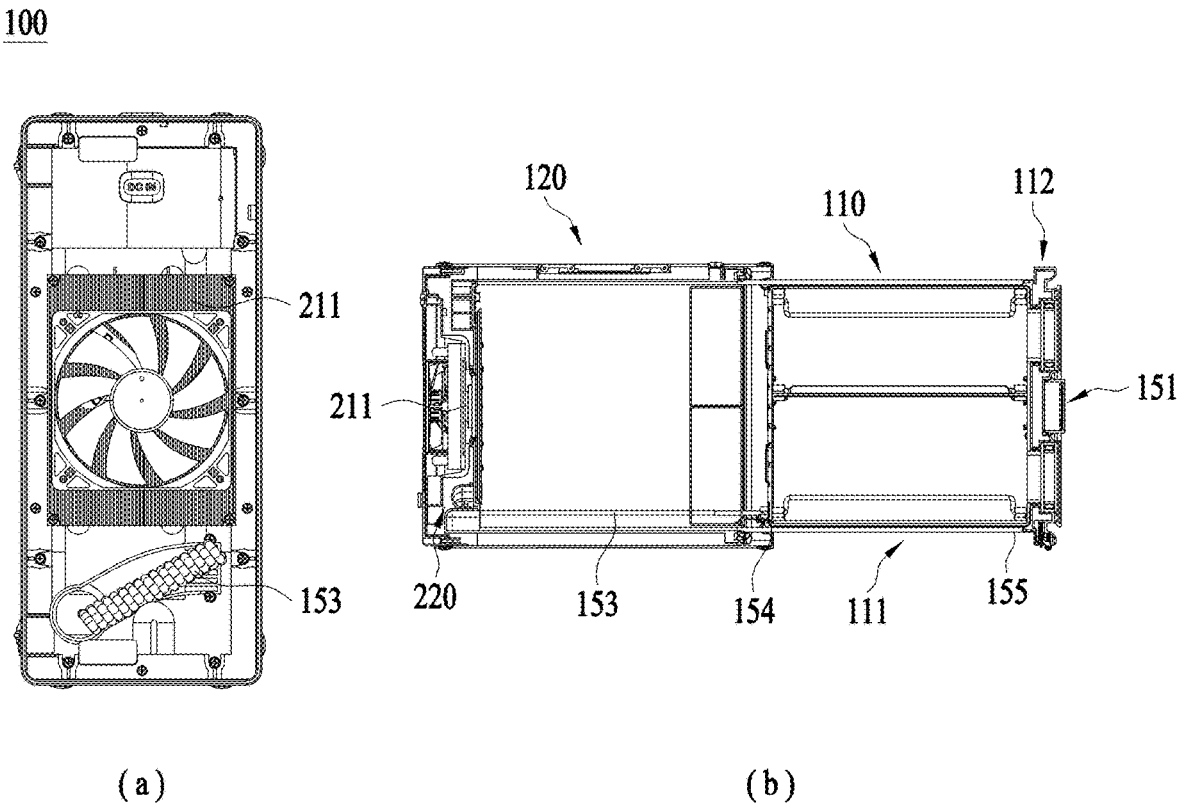
FIG. 20 illustrates examples of a rear portion and a cross section of the portable refrigerator.

FIG. 20 illustrates a rear portion and a cross section of the portable refrigerator 100.

In some implementations, the display part 151 can be provided on the drawer 110 and include a structure for connecting the power supplied to the case 120 to the display part 151. For example, a variable cable 153 connects the display part 151 provided on the drawer 110 and the power supply 220 provided in the case 120.

The variable cable 153 can connect the power supply 220 of the case 120 and a frame terminal 154 provided on the rear surface of the frame 1112 of the drawer 110. The frame 111 can include an electrically conductive line 155 for electrically connecting the frame terminal 154 and the display part 151.

The variable cable 153 can be provided in a coil method capable of tension and contraction so as not to interfere with other members when the variable cable 153 is contracted.

When the drawer 110 is fully drawn into the case 120, the width of the space in which the variable cable 153 is provided may not be large. In the narrow space, when the variable cable 153 is hung and provided arbitrarily, the variable cable 153 can cause a jamming problem between the drawer 110 and the case 120. The variable cable 153 of a coil-type can be contracted an appropriate length as the drawer 110 is drawn into the case 120, so there is no risk of jamming.

Figure 21:
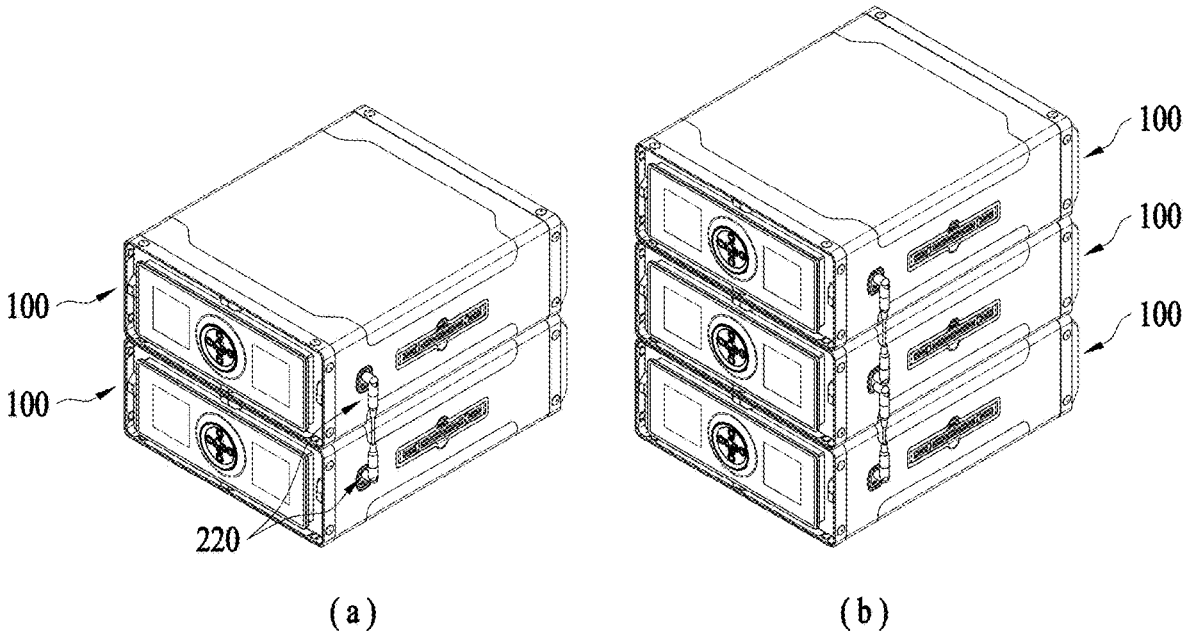
FIG. 21 illustrates an example of a plurality of portable refrigerators.

FIG. 21 illustrates that a plurality of portable refrigerators 100 are provided.

In some examples, a plurality of the portable refrigerators 100 can be provided and stacked. The plurality of the portable refrigerators 100 can share a single power supply by connecting power supplies 220 to each other. For instance, external power can be connected to only one power supply 220 among the plurality of portable refrigerators 100, and each power supply 220 of the plurality of the portable refrigerators 100 can be connected to each other. In order to have a stable structure when the portable refrigerators 100 are stacked, two wide surfaces 1201 facing each other of the portable refrigerator 100 can have a shape to engage with each other.

It is apparent to those skilled in the art that the present disclosure can be materialized in other specific forms without departing from the spirit and essential characteristics of the present disclosure.

The above detailed description should not be construed as limiting in all aspects and should be considered as illustrative. The scope of the disclosure should be determined by reasonable interpretation of the appended claims, and all changes within the equivalent scope of the disclosure are included in the scope of the disclosure.

What is claimed is:

1. A portable refrigerator that is configured to be accommodated in a first cooling space of a main refrigerator and defines a second cooling space independent of the first cooling space, the portable refrigerator comprising:

a case that defines an opening;

a drawer configured to be inserted into and drawn out from the case through the opening of the case, the drawer being configured to, based on being inserted into the case, cover the opening and the second cooling space;

a temperature control part configured to control a temperature of the second cooling space; and a power supply configured to be selectively connected to external power or indirect power, the indirect power being supplied through the main refrigerator, wherein the drawer comprises a rolling member configured to facilitate the drawer being inserted into and drawn out from the case and configured to be supported on a floor based on the drawer being drawn out from the case, and wherein the rolling member of the drawer is configured to be drawn into the drawer based on the drawer being drawn into the case and to protrude outward of the drawer based on the drawer being drawn out from the case.

2. The portable refrigerator of claim 1, wherein the temperature control part comprises a thermo-electric module.

3. The portable refrigerator of claim 1, wherein the temperature control part has a first side disposed at an outer surface of the case and a second side disposed at an inner surface of the case.

4. The portable refrigerator of claim 1, wherein the temperature control part is configured to set an operating temperature range of the second cooling space based on an outside temperature of the case.

5. The portable refrigerator of claim 1, wherein the temperature control part is configured to set an operating temperature range of the second cooling space based on whether the power supply is connected to the external power or the indirect power.

6. The portable refrigerator of claim 1, further comprising a controller configured to:

determine whether the portable refrigerator is accommodated in the first cooling space; and set an operating temperature range of the second cooling space based on determining whether the portable refrigerator is accommodated in the first cooling space.

7. The portable refrigerator of claim 1, wherein the case has a rectangular parallelepiped shape including (i) an opening surface that defines the opening, (ii) a pair of first surfaces that face each other, and (iii) a pair of second surfaces that face each other, and wherein a width of each of the pair of first surfaces is greater than a width of each of the pair of second surfaces.

8. The portable refrigerator of claim 7, wherein the case comprises a rolling member that is disposed at one of the pair of first surfaces.

9. The portable refrigerator of claim 7, wherein the drawer comprises a frame that defines:

two open sides that face the pair of first surfaces of the case, each of the two open sides defining an opening area; and two closed sides that face the pair of second surfaces of the case.

10. The portable refrigerator of claim 9, wherein the drawer further comprises a blocking bar that extends through at least a part of the opening area of the drawer.

11. The portable refrigerator of claim 9, wherein the drawer further comprises an auxiliary frame that extends parallel to the two closed sides of the frame and is disposed between the two closed sides of the frame, the auxiliary frame partitioning the opening area into a plurality of opening areas.

12. The portable refrigerator of claim 9, wherein the pair of first surfaces of the case are configured to face a floor, and wherein the portable refrigerator further comprises a basket that is disposed in the opening area of the frame and defines a recessed storage space.

13. The portable refrigerator of claim 9, wherein the rolling member of the drawer is configured to face one of the pair of first surfaces of the case or one of the pair of second surfaces of the case.

14. The portable refrigerator of claim 7, wherein the case further comprises a handle disposed at one of the pair of second surfaces of the case, and wherein the handle comprises a link that enables the handle to protrude from and insert into the one of the pair of second surfaces of the case.

15. The portable refrigerator of claim 7, wherein the portable refrigerator is configured to be stacked with a plurality of portable refrigerators that have a structure identical to the portable refrigerator, wherein the case of each of the plurality of portable refrigerators has one of the pair of first surfaces that is configured to face one of a first pair of surfaces of another of the plurality of portable refrigerators, and wherein the power supplies of the plurality of portable refrigerators are configured to connect to one another and to a single power source.

16. The portable refrigerator of claim 1, wherein the power supply comprises a power terminal disposed at the case and configured to receive power.

17. The portable refrigerator of claim 16, wherein the drawer comprises:

a display configured to output visual information; and a cable that is connected to the display and the power supply, the cable comprising a coil configured to be stretched and contracted.

18. The portable refrigerator of claim 17, wherein the display is disposed at a front surface of the drawer, and wherein the drawer comprises a frame comprising:

a rear surface that faces the front surface of the drawer, a frame terminal disposed at the rear surface of the frame and connected to the cable of the drawer, and a conductive line that electrically connects the frame terminal to the display, and wherein the display is disposed at a front surface of the drawer, the display comprising a display panel that is disposed at the front surface of the drawer and configured to rotate in a range of 90 degrees about an axis perpendicular to the front surface of the drawer.

19. A refrigerator that defines a first cooling space, the refrigerator comprising:

a portable refrigerator that is configured to be accommodated in the first cooling space and defines a second cooling space independent of the first cooling space, the portable refrigerator comprising a power terminal;

a heat pump configured to cool the first cooling space; and a power supply configured to supply power to the portable refrigerator accommodated in the refrigerator, wherein the power supply comprises:

a housing, a cable disposed in the housing and configured to be connected to the power terminal of the portable refrigerator, and an elastic member configured to apply force to the cable based on the cable being drawn out of the housing to be connected to the portable refrigerator, the elastic member being further configured to insert the cable into the housing based on the cable being disconnected from the portable refrigerator.

20. A refrigerator in which a portable refrigerator that independently forms a second cooling space is accommodated, comprising:

a heat pump; and a power supplying part configured to supply power to the portable refrigerator accommodated in the refrigerator, wherein the power supplying part comprises:

a power line and a power line head to be connected to a power terminal of the portable refrigerator; and an elastic member configured to connect the power line and the power line head to the power terminal of the portable refrigerator in a state in which the power line and the power line head are elastically drawn out, and allow the power line and the power line head to be drawn in when not connected to the portable refrigerator.

* * * * *